US008511323B2

(12) United States Patent
Jimenez et al.

(10) Patent No.: US 8,511,323 B2
(45) Date of Patent: Aug. 20, 2013

(54) ORAL CARE DISPENSER AND ORAL CARE SYSTEM IMPLEMENTING THE SAME

(75) Inventors: Eduardo J. Jimenez, Manalapan, NJ (US); Sharon Kennedy, Randallstown, MD (US); Alan Sorrentino, Cranbury, NJ (US); John J. Gatzemeyer, Hillsborough, NJ (US); Michael Rooney, Millburn, NJ (US); Joseph E. Fattori, East Sandwich, MA (US)

(73) Assignee: Colgate-Palmolive Company, New York, NY (US)

( * ) Notice: Subject to any disclaimer, the term of this patent is extended or adjusted under 35 U.S.C. 154(b) by 42 days.

(21) Appl. No.: 13/318,291

(22) PCT Filed: Aug. 1, 2011

(86) PCT No.: PCT/US2011/046132

§ 371 (c)(1),
(2), (4) Date: Oct. 31, 2011

(87) PCT Pub. No.: WO2012/082185

PCT Pub. Date: Jun. 21, 2012

(65) Prior Publication Data

US 2012/0272996 A1 Nov. 1, 2012

Related U.S. Application Data

(63) Continuation-in-part of application No. PCT/US2011/045010, filed on Jul. 22, 2011, which is a continuation-in-part of application No. PCT/US2010/060874, filed on Dec. 22, 2010, which is a continuation-in-part of application No. PCT/US2010/060867, filed on Dec. 16, 2010, which is a continuation-in-part of application No. PCT/US2010/060861, filed on Dec. 16, 2010, which is a continuation-in-part of application No. PCT/US2010/060877, filed on Dec. 16, 2010, which is a continuation-in-part of application No. PCT/US2010/060881, filed on Dec. 16, 2010, which is a continuation-in-part of application No. PCT/US2009/069408, filed on Dec. 23, 2009, which is a continuation-in-part of application No. PCT/US2009/069402, filed on Dec. 23, 2009.

(60) Provisional application No. 61/423,414, filed on Dec. 15, 2010, provisional application No. 61/423,397, filed on Dec. 15, 2010, provisional application No. 61/423,449, filed on Dec. 15, 2010, provisional application No. 61/423,435, filed on Dec. 15, 2010, provisional application No. 61/410,514, filed on Nov. 5, 2010.

(51) Int. Cl.
*A46B 11/02* (2006.01)
*B65D 83/00* (2006.01)

(52) U.S. Cl.
USPC ..... 132/311; 132/308; 401/174; 401/175; 222/39; 222/390

(58) Field of Classification Search
USPC ..... 132/308, 311, 320; 222/39, 192, 222/390; 433/36, 80, 82, 88, 89, 90; 401/172, 401/174, 175
See application file for complete search history.

(56) References Cited

U.S. PATENT DOCUMENTS 64,732 A 5/1867 Wylie
261,456 A 7/1882 Hoffman (Continued)

FOREIGN PATENT DOCUMENTS

CN 201025977 2/2008
DE 2725495 12/1977

(Continued)

OTHER PUBLICATIONS

International Search Report and Written Opinion in International Application No. PCT/US10/60881 mailed May 16, 2011.

*Primary Examiner* — Robyn Doan
*Assistant Examiner* — Tatiana Nobrega
(74) *Attorney, Agent, or Firm* — Ryan M. Flandro

(57) ABSTRACT

An oral care dispenser and oral care system implementing the same. In one embodiment, the dispenser may comprise a collar having an axial passageway in which a drive component is rotatably coupled. The collar comprises a segmented neck portion and a non-segmented body portion that comprises a plurality of protuberances extending into the axial passageway. The drive component comprises at least one resilient arm that interacts with the plurality of protuberances to generate an audible signal during relative rotation.

28 Claims, 13 Drawing Sheets

(56) References Cited

U.S. PATENT DOCUMENTS 766,556 A 8/1904 Symonds
1,062,480 A 5/1913 Larocque
1,244,324 A 10/1917 Hackley
1,292,416 A 11/1919 Auld
1,546,516 A 7/1925 Smith
1,555,064 A 9/1925 La Mothe
1,668,511 A 5/1928 McLaughlin
1,701,030 A 2/1929 Collins
1,746,474 A 2/1930 Hogner
1,975,723 A 10/1934 Johnssen
2,068,213 A 1/1937 Wilson
2,399,660 A 6/1941 Smith et al.
D134,723 S 1/1943 Riksheim
2,356,874 A 8/1944 Nageotte
2,437,769 A 3/1948 Traylor
2,438,641 A 3/1948 Loehr
2,445,571 A 7/1948 Fuston
2,418,033 A 8/1948 Kruck
2,521,882 A 9/1950 Swift et al.
2,541,949 A 2/1951 Thacker et al.
2,579,899 A 12/1951 Burrows
2,637,060 A 5/1953 Cowan
2,670,881 A 3/1954 Sjoblom
2,676,568 A 4/1954 Maczynski
2,718,299 A 9/1955 Atwater et al.
2,771,858 A 11/1956 Cribbs et al.
2,800,899 A 7/1957 Barron
2,845,645 A 8/1958 Wishnefsky et al.
2,885,110 A 5/1959 Tregilgas
2,885,116 A 5/1959 Tregilgas
2,968,827 A 1/1961 Leo et al.
3,108,687 A 10/1963 Dayton
3,148,684 A 9/1964 Keeler
3,187,758 A 6/1965 Eklund
3,215,320 A 11/1965 Heisler et al.
3,293,749 A 12/1966 George et al.
3,296,642 A 1/1967 Aylott
3,358,699 A 12/1967 Bau
3,359,991 A 12/1967 Spatz
3,359,992 A 12/1967 Cishek et al.
3,378,176 A 4/1968 Snyder
3,406,694 A 10/1968 Odence
3,468,612 A 9/1969 Aston
3,683,924 A 8/1972 Louie
3,910,706 A 10/1975 Del Bon
3,986,645 A 10/1976 Baldwin et al.
4,122,983 A * 10/1978 Jolly ..... 222/390
4,201,491 A 5/1980 Kohler
4,275,750 A 6/1981 Clark
4,277,194 A 7/1981 Smith
4,296,518 A 10/1981 Furrier et al.
4,323,157 A 4/1982 Idec
4,331,267 A 5/1982 Duncan et al.
4,340,367 A 7/1982 Vadas et al.
4,350,712 A 9/1982 Kocharian et al.
4,384,645 A 5/1983 Manfredi
4,413,760 A 11/1983 Paton
4,506,810 A 3/1985 Goncalves
4,527,574 A 7/1985 Manfredi
4,543,679 A 10/1985 Rosofsky et al.
4,573,820 A 3/1986 Kirchhoff
4,582,059 A 4/1986 Tiwari
4,594,015 A 6/1986 Pomares
4,641,766 A 2/1987 Vlasich
4,655,372 A 4/1987 Ross et al.
4,659,327 A 4/1987 Bennett et al.
4,662,385 A 5/1987 Schefer
4,763,815 A 8/1988 Von Schuckmann et al.
4,767,032 A 8/1988 Smith
4,776,717 A 10/1988 Iizuka et al.
4,808,022 A 2/1989 Iizuka et al.
4,826,341 A 5/1989 Kwak
4,865,481 A 9/1989 Scales
4,866,809 A 9/1989 Pelletier
4,874,117 A 10/1989 Kay et al.
4,879,781 A 11/1989 Desimone
4,886,186 A 12/1989 Andris
4,887,924 A 12/1989 Green
4,892,427 A 1/1990 Ford
D310,308 S 9/1990 Wolsey
4,954,000 A 9/1990 Gueret
4,997,299 A 3/1991 Ohba
5,000,356 A 3/1991 Johnson et al.
5,011,317 A 4/1991 Gueret
5,016,782 A 5/1991 Pfanstiel
5,018,892 A 5/1991 Krueckel et al.
5,028,158 A 7/1991 Fey
5,066,155 A 11/1991 English et al.
5,156,479 A 10/1992 Iizuka
5,181,790 A * 1/1993 Lucas ..... 401/75
5,199,807 A 4/1993 Uchida
1,913,528 A 6/1993 White
5,217,475 A 6/1993 Kuber
5,234,136 A 8/1993 Kopis
5,244,298 A 9/1993 Greenhouse
5,249,876 A 10/1993 Hattman
5,294,205 A 3/1994 Moeck et al.
5,336,005 A 8/1994 Moeck et al.
5,403,105 A 4/1995 Jameson
5,423,623 A 6/1995 Bakic
5,425,591 A 6/1995 Contreras et al.
5,454,660 A 10/1995 Sakurai et al.
5,540,361 A 7/1996 Fattori
5,547,302 A 8/1996 Dornbusch et al.
5,560,518 A 10/1996 Catterall et al.
5,569,278 A 10/1996 Persad
5,573,341 A 11/1996 Iaia
5,608,940 A 3/1997 Panyon, Jr.
5,611,687 A 3/1997 Wagner
5,695,788 A 12/1997 Woods
5,697,531 A 12/1997 Fattori
5,709,004 A 1/1998 Paduano et al.
5,725,133 A 3/1998 Iaia
5,733,058 A 3/1998 Hofmann
5,765,573 A 6/1998 Gueret
5,772,347 A 6/1998 Gueret
5,791,801 A 8/1998 Miller
5,803,640 A 9/1998 Nakajima et al.
5,827,002 A 10/1998 Nakajima
5,827,308 A 10/1998 Thakur et al.
5,839,622 A 11/1998 Bicknell et al.
5,851,079 A * 12/1998 Horstman et al. ..... 401/174
5,860,572 A 1/1999 Harrold et al.
5,862,817 A 1/1999 Lee
5,879,095 A 3/1999 Gueret
5,893,860 A 4/1999 Ripich et al.
5,911,532 A 6/1999 Evancic
5,916,228 A 6/1999 Ripich et al.
5,941,254 A 8/1999 Heler
5,955,114 A 9/1999 Llanos
5,970,990 A 10/1999 Dunton et al.
5,980,145 A 11/1999 Griffith
5,996,850 A 12/1999 Morali et al.
6,015,293 A 1/2000 Rimkus
6,039,053 A 3/2000 Turrentine
6,056,469 A 5/2000 Algorri
6,056,763 A 5/2000 Parsons
6,070,598 A 6/2000 Gueret
6,071,026 A 6/2000 Martinez et al.
6,082,918 A 7/2000 Gueret
6,086,276 A 7/2000 Gueret
6,099,315 A 8/2000 Markowitz
6,200,055 B1 3/2001 Fusaro, Jr.
6,202,247 B1 3/2001 Lorenz, Jr.
6,210,061 B1 4/2001 Johnson
6,213,662 B1 4/2001 Aljanedi
6,220,773 B1 4/2001 Wiegner et al.
6,224,573 B1 5/2001 Yeager et al.
6,227,209 B1 5/2001 Kim et al.
6,227,739 B1 * 5/2001 Kageyama ..... 401/172
6,238,117 B1 5/2001 Griebel et al.
6,290,417 B1 9/2001 Kaminski
6,325,076 B1 12/2001 Ramirez
6,331,085 B1 12/2001 Schrepf et al.

| | | | | |
|---|---|---|---|---|
| 6,345,629 | B1 | 2/2002 | Vives | |
| 6,363,949 | B1 | 4/2002 | Brown | |
| 6,368,001 | B1 | 4/2002 | Roeder | |
| 6,398,439 | B1 | 6/2002 | Szekely | |
| 6,406,694 | B1 | 6/2002 | LaRosa | |
| 6,439,885 | B2 | 8/2002 | Antler | |
| 6,440,149 | B1 | 8/2002 | Potti | |
| 6,450,716 | B1 | 9/2002 | Szekely | |
| 6,475,172 | B1 | 11/2002 | Hall | |
| 6,488,427 | B1 | 12/2002 | Breidenbach et al. | |
| 6,592,281 | B2 | 7/2003 | Clark et al. | |
| 6,607,323 | B2 | 8/2003 | Breidenbach et al. | |
| 6,647,581 | B1 | 11/2003 | Persad et al. | |
| 6,648,641 | B1 | 11/2003 | Viltro et al. | |
| 6,672,783 | B1 | 1/2004 | Licata et al. | |
| 6,688,317 | B2 | 2/2004 | Gueret | |
| 6,688,793 | B2 | 2/2004 | Goyet | |
| 6,688,796 | B1 | 2/2004 | Lin | |
| 6,745,781 | B2 | 6/2004 | Gueret | |
| 6,746,170 | B2 * | 6/2004 | Delage | 401/266 |
| 6,752,558 | B1 * | 6/2004 | Hsu | 401/270 |
| 6,824,018 | B1 | 11/2004 | Eaddy et al. | |
| 6,866,438 | B2 | 3/2005 | Bauer et al. | |
| 6,880,999 | B2 | 4/2005 | Biegel et al. | |
| 6,918,511 | B1 | 7/2005 | Spatz et al. | |
| 6,923,349 | B2 * | 8/2005 | Lou | 222/521 |
| 6,923,587 | B2 | 8/2005 | Lee | |
| 6,957,753 | B2 | 10/2005 | Tani | |
| 7,029,484 | B2 | 4/2006 | Ripich | |
| 7,044,671 | B2 | 5/2006 | Parikh et al. | |
| 7,051,642 | B2 | 5/2006 | Kageyama | |
| 7,055,527 | B2 | 6/2006 | Tien | |
| 7,086,564 | B1 | 8/2006 | Corrigan | |
| 7,086,796 | B2 | 8/2006 | Severa | |
| 7,089,564 | B2 | 8/2006 | Chen et al. | |
| 7,114,505 | B2 | 10/2006 | Bauer et al. | |
| 7,143,462 | B2 | 12/2006 | Hohlbein | |
| 7,144,175 | B2 | 12/2006 | Biegel | |
| 7,147,396 | B2 * | 12/2006 | Tani | 401/266 |
| 7,168,435 | B2 | 1/2007 | Vieu et al. | |
| 7,192,212 | B2 | 3/2007 | Gutberlet et al. | |
| 7,201,527 | B2 * | 4/2007 | Thorpe et al. | 401/269 |
| 7,210,870 | B2 | 5/2007 | Breidenbach et al. | |
| 7,217,054 | B2 | 5/2007 | Noguchi | |
| 7,226,231 | B2 | 6/2007 | Py et al. | |
| 7,237,974 | B2 | 7/2007 | Pfenniger et al. | |
| 7,237,975 | B2 | 7/2007 | Noguchi | |
| 7,261,559 | B2 * | 8/2007 | Smith et al. | 433/90 |
| 7,264,471 | B2 | 9/2007 | Malemacher | |
| 7,293,928 | B2 | 11/2007 | Lane | |
| 7,303,348 | B2 | 12/2007 | Phipps et al. | |
| 7,309,184 | B2 | 12/2007 | Butcher et al. | |
| 7,309,185 | B2 * | 12/2007 | Thorpe et al. | 401/277 |
| 7,325,707 | B2 * | 2/2008 | Bougamont et al. | 222/390 |
| 7,331,731 | B2 | 2/2008 | Hohlbein et al. | |
| 7,347,360 | B2 | 3/2008 | Lasch et al. | |
| 7,374,360 | B1 | 5/2008 | Szekely | |
| 7,396,180 | B2 | 7/2008 | Bugla et al. | |
| 7,399,133 | B1 | 7/2008 | Eversole | |
| 7,401,373 | B2 | 7/2008 | Tybinkowski et al. | |
| 7,461,988 | B2 | 12/2008 | Albisetti | |
| 7,465,113 | B2 | 12/2008 | Gueret | |
| 7,474,048 | B2 | 1/2009 | Forrest et al. | |
| 7,481,591 | B2 | 1/2009 | Dumler | |
| 7,520,406 | B2 | 4/2009 | Jaichandra et al. | |
| 7,540,054 | B2 | 6/2009 | Goldstein | |
| 7,557,936 | B2 | 7/2009 | Dickinson | |
| 7,614,811 | B2 | 11/2009 | Kaufman et al. | |
| 7,641,411 | B2 | 1/2010 | Biegel | |
| 7,651,291 | B2 | 1/2010 | Py et al. | |
| 7,665,923 | B2 | 2/2010 | Py et al. | |
| 7,677,827 | B1 | 3/2010 | Manukian | |
| 7,731,440 | B2 * | 6/2010 | Tani | 401/75 |
| 7,823,593 | B2 | 11/2010 | Gueret | |
| 8,016,507 | B2 | 9/2011 | Wright | |
| 8,172,472 | B2 * | 5/2012 | Tani | 401/78 |
| 8,277,137 | B2 * | 10/2012 | Sawata | 401/265 |
| 8,328,447 | B2 * | 12/2012 | Tani | 401/172 |
| 2002/0054783 | A1 | 5/2002 | Gueret | |
| 2002/0073496 | A1 | 6/2002 | Kim | |
| 2003/0012594 | A1 | 1/2003 | Andersen | |
| 2003/0057236 | A1 | 3/2003 | Delage | |
| 2004/0028456 | A1 | 2/2004 | Giraldo | |
| 2004/0092981 | A1 | 5/2004 | Barlow et al. | |
| 2004/0237996 | A1 | 12/2004 | Fischer et al. | |
| 2004/0240928 | A1 | 12/2004 | Trocino | |
| 2005/0006409 | A1 | 1/2005 | Ganzeboom | |
| 2005/0026774 | A1 | 2/2005 | Nolan | |
| 2005/0036821 | A1 | 2/2005 | Pfenniger et al. | |
| 2005/0069372 | A1 | 3/2005 | Hohlbein et al. | |
| 2005/0178800 | A1 * | 8/2005 | Tani | 222/390 |
| 2005/0199655 | A1 | 9/2005 | Petit | |
| 2006/0058821 | A1 | 3/2006 | Jansheski | |
| 2006/0072963 | A1 * | 4/2006 | Thorpe et al. | 401/277 |
| 2006/0207627 | A1 * | 9/2006 | Thorpe et al. | 132/320 |
| 2006/0233588 | A1 | 10/2006 | Gueret | |
| 2006/0260635 | A1 | 11/2006 | Dabney | |
| 2006/0269351 | A1 | 11/2006 | Mcafee | |
| 2006/0269354 | A1 | 11/2006 | Lane | |
| 2006/0272666 | A1 | 12/2006 | Wyatt et al. | |
| 2006/0275225 | A1 | 12/2006 | Prencipe et al. | |
| 2007/0007302 | A1 | 1/2007 | Jaichandra et al. | |
| 2007/0079845 | A1 | 4/2007 | Gueret | |
| 2007/0086830 | A1 * | 4/2007 | Kageyama | 401/172 |
| 2007/0227553 | A1 | 10/2007 | Gueret | |
| 2007/0231055 | A1 | 10/2007 | Albisetti | |
| 2007/0292194 | A1 | 12/2007 | Albisetti et al. | |
| 2008/0063464 | A1 | 3/2008 | Prague | |
| 2008/0089733 | A1 | 4/2008 | Lochak | |
| 2008/0101850 | A1 | 5/2008 | Wojcik et al. | |
| 2008/0118300 | A1 | 5/2008 | Burrowes | |
| 2008/0189888 | A1 | 8/2008 | Hohlbein | |
| 2008/0274066 | A1 | 11/2008 | Montgomery | |
| 2009/0074679 | A1 | 3/2009 | Silverman | |
| 2009/0254055 | A1 | 10/2009 | Clarke | |
| 2009/0261007 | A1 | 10/2009 | Sanchez | |
| 2009/0288262 | A1 | 11/2009 | Hall | |
| 2009/0317432 | A1 | 12/2009 | Kergosien | |
| 2009/0324321 | A1 * | 12/2009 | Nasu et al. | 401/172 |
| 2010/0168638 | A1 | 7/2010 | Korogi et al. | |
| 2010/0240013 | A1 | 9/2010 | Levine | |
| 2010/0284726 | A1 | 11/2010 | Ottaviani et al. | |
| 2011/0308030 | A1 | 12/2011 | Jimenez et al. | |
| 2012/0014739 | A1 * | 1/2012 | Zhang | 401/175 |
| 2012/0114410 | A1 | 5/2012 | Jimenez et al. | |
| 2012/0163902 | A1 | 6/2012 | Jimenez et al. | |

FOREIGN PATENT DOCUMENTS

| | | |
|---|---|---|
| DE | 3832224 | 8/1989 |
| DE | 29613012 | 10/1996 |
| EP | 0308549 | 3/1989 |
| EP | 0385815 | 9/1990 |
| EP | 1506726 | 2/2005 |
| FR | 850458 | 12/1939 |
| FR | 907669 | 3/1946 |
| FR | 1596074 | 6/1970 |
| FR | 2597734 | 10/1987 |
| GB | 666082 | 2/1952 |
| GB | 792448 | 3/1958 |
| GB | 1190280 | 4/1970 |
| GB | 7085717 | 5/1982 |
| GB | 2280361 | 2/1995 |
| GB | 2307674 | 6/1997 |
| GB | 2393642 | 4/2004 |
| JP | 48-093167 | 12/1973 |
| NL | 2002311 | 6/2010 |
| WO | WO 93/03648 | 3/1993 |
| WO | WO 96/01579 | 1/1996 |
| WO | WO 98/09572 | 3/1998 |
| WO | WO 98/18695 | 5/1998 |
| WO | WO 01/00103 | 1/2001 |
| WO | WO 02/17967 | 3/2002 |
| WO | WO 2004/112637 | 12/2004 |
| WO | WO 2005/065373 | 7/2005 |
| WO | WO 2008/062935 | 5/2008 |
| WO | WO 2009/151455 | 12/2009 |
| WO | WO 2010/132590 | 11/2010 |
| WO | WO 2011/078863 | 6/2011 |

| | | |
|---|---|---|
| WO | WO 2011/078864 | 6/2011 |
| WO | WO 2011/079027 | 6/2011 |
| WO | WO 2011/079028 | 6/2011 |
| WO | WO 2012/082102 | 6/2012 |
| WO | WO 2012/082183 | 6/2012 |
| WO | WO 2012/082185 | 6/2012 |

OTHER PUBLICATIONS

International Search Report and Written Opinion in International Application No. PCT/US09/069408 mailed Jul. 23, 2010.
International Search Report and Written Opinion in International Application No. PCT/US09/069402 mailed Jul. 23, 2010.
International Search Report and Written Opinion in International Application No. PCT/US10/060861 mailed Jun. 8, 2011.
International Search Report and Written Opinion in International Application No. PCT/US10/049102 mailed Jun. 7, 2011.
International Search Report and Written Opinion in International Application No. PCT/US10/060877 mailed Oct. 7, 2011.
International Search Report and Written Opinion in International Application No. PCT/US11/023356 mailed Oct. 21, 2011.
International Search Report and Written Opinion in International Application No. PCT/US10/060105 mailed Aug. 30, 2011.
Written Opinion for PCT/US2009/069402 mailed on Dec. 16, 2011.
Written Opinion for PCT/US2009/069408 mailed on Dec. 16, 2011.
ISR and Written Opinion for PCT/US2010/060867 mailed on Oct. 14, 2011.
ISR and Written Opinion for PCT/US2010/060874 mailed on Jan. 11, 2012.
Written Opinion for PCT/US2010/060881 mailed on Dec. 28, 2011.
ISR and Written Opinion for PCT/US2011/045010 mailed on Nov. 25, 2011.
Written Opinion for PCT/US2011/046132, mailed Nov. 26, 2012.
International Search Report and Written Opinion in International Application No. PCT/US11/046132, mailed Dec. 1, 2011.

* cited by examiner

ORAL CARE DISPENSER AND ORAL CARE SYSTEM IMPLEMENTING THE SAME

CROSS-REFERENCE TO RELATED APPLICATIONS

This application is a national stage application of International Application No. PCT/US2011/046132, filed Aug. 1, 2011, which is a continuation-in-part of (1) PCT/US2011/045010, filed Jul. 22, 2011; (2) PCT/US2010/060874, filed Dec. 22, 2010, which is the non-provisional of U.S. Provisional Application No. 61/423,414, filed Dec. 15, 2010; (3) PCT/US2010/060867, filed Dec. 16, 2010, which is a non-provisional of U.S. Provisional Application No. 61/423,397, filed Dec. 15, 2010; (4) PCT/US2010/060861, filed Dec. 16, 2010, which is a non-provisional of U.S. Provisional Application No. 61/423,449, filed Dec. 15, 2010; (5) PCT/US2010/060877, filed Dec. 16, 2010, which is a non-provisional of U.S. Provisional Application No. 61/423,435, filed Dec. 15, 2010; (6) PCT/US2010/060881, filed Dec. 16, 2010, which is a non-provisional of U.S. Provisional Application No. 61/410,514, filed Nov. 5, 2010; (7) PCT/US2009/069408, filed Dec. 23, 2009; and (8) PCT/US2009/069402, filed Dec. 23, 2009.

FIELD OF THE INVENTION

The present invention relates generally to oral care dispensers and oral care systems.

BACKGROUND OF THE INVENTION

Oral care products or agents are applied in different ways. For example, without limitation, a common technique used for tooth whitening products is to cast an impression of a person's teeth and provide a tray of the shape of this impression. A person then only needs to add a whitening composition to the tray and to apply the tray to his/her teeth. This is left in place for a period of time and then removed. After a few treatments the teeth gradually whiten. Another technique is to use a strip that has a whitening composition on one surface. This strip is applied to a person's teeth and left in place for about 30 minutes. After several applications the teeth are gradually whitened. Yet another technique is to apply a whitening composition to teeth using a small brush. This brush is repeatedly dipped back into the container during the application of the tooth whitening composition to one's teeth. After a few treatments the teeth gradually whiten.

A problem with existing brushing techniques is that saliva in the mouth contains the enzyme catalase. This enzyme will catalize the decomposition of peroxides. The brush can pick up some catalase during the application of some of the whitening product to teeth and transport that catalase back to the bottle. This catalase now in the bottle can degrade the peroxide in the bottle. Another problem with this latter technique is that it does not adapt for use with anhydrous whitening compositions. Here the brush may transport moisture from saliva from the mouth back into the bottle. This will have a negative effect on the whitening composition by potentially decomposing the peroxide active ingredient. In addition, if a person washes the brush each time after use, moisture from the wet bristles can enter the bottle.

While tray-based systems are suitable, many people do not use them due to the fact that they tend to be uncomfortable and/or awkward. Moreover, in order to use a whitening tray, a user must keep the tray and the required components at hand.

This not only requires extra storage space in already cramped bathroom cabinets but also requires that the user remember to use the whitening system. Furthermore, these tray-based systems are not conveniently portable for transport and/or travel.

In addition to difficulties in applying some oral care products, storage is sometimes cumbersome and inconvenient for the user. The oral care product must typically be stored separately from oral care tooth cleaning implements such as a toothbrush since the oral care product package and toothbrush heretofore are generally treated as separate and distinct parts of an oral care regimen.

A more portable, compact and convenient way to store oral care products, and to dispense and apply those oral care products to oral surfaces is desired.

BRIEF SUMMARY OF THE INVENTION

Embodiments of the present invention provide an efficient, compact, and portable oral care system that combines an oral care implement such as a toothbrush with a fluid dispenser in a highly portable and convenient housing. Advantageously, such embodiments are especially suited for easy transport and/or travel.

Exemplary embodiments of the present invention are directed to a toothbrush that detachably retains a removable dispenser containing a fluid reservoir. In some exemplary embodiments, the oral care system includes fluid such as fluidic oral care materials, either active or non-active agents, that may include without limitation, whitening, enamel protection, anti-sensitivity, fluoride, tartar protection, or other oral care materials. The dispenser can be detachably docked and stored at least partially within the handle of the toothbrush so that a portion of the dispenser protrudes from the toothbrush, or forms a proximal end of the toothbrush handle, to permit access to a user for easy removal and use of the dispenser. The dispenser can be completely removable from the toothbrush in certain embodiments so that the user can apply the fluid to his/her teeth with ease, and then reinsert the dispenser in the toothbrush for convenient storage. In certain embodiments, the dispenser may be a pen-like component. The toothbrush can removably and non-fixedly secure the dispenser within the handle so that the dispenser can be repetitively removed and reinserted therein. In some embodiments, the dispenser may be adapted to be user-refillable for repeated use.

In one embodiment, the invention can be an oral care dispenser comprising a housing having a longitudinal axis and an internal reservoir containing a fluid; a collar non-rotatably coupled to the housing, the collar comprising an axial passageway, a neck portion having an inner surface forming a first section of the axial passageway, a body portion forming a second section of the axial passageway, and a plurality of protuberances extending radially inward from an inner surface of the body portion, the neck portion formed by a plurality of segments that protrude axially from the body portion, wherein adjacent ones of the plurality of segments are separated by a gap; a drive component rotatably coupled to the collar, the drive component comprising a first annular flange located adjacent a distal edge of the neck portion, a drive screw extending from the first annular flange in a first axial direction, a post extending from the first annular flange in a second axial direction and through the axial passageway, and at least one resilient arm extending radially outward from the post in the second section of the axial passageway; and wherein rotation of an actuator in a first rotational direction causes: (1) an elevator to axially advance along the drive screw in the first axial direction to dispense the fluid from a dispensing orifice; and (2) the at least one resilient arm to move over the plurality of protuberances, the at least one resilient arm deforming when moving over each of the plurality of protuberances and resuming an original state upon passing each of the plurality of protuberances to generate an audible signal.

In another embodiment, the invention can be an oral care dispenser comprising: a housing having a longitudinal axis and an internal reservoir containing a fluid; a collar non-rotatably coupled to the housing, the collar comprising an inner surface forming an axial passageway, the inner surface of the collar comprising a plurality of features arranged in a circumferentially spaced-apart manner about the longitudinal axis; a drive component rotatably coupled to the collar, the drive component comprising a drive screw, a post, and one or more resilient arms extending radially outward from the post, the one or more resilient arms being curved in a second rotational direction about the longitudinal axis; wherein rotation of an actuator in a first rotational direction causes: (1) an elevator to axially advance along the drive screw in a first axial direction to dispense the fluid from a dispensing orifice; and (2) the one or more resilient arms to move over the plurality of features; and wherein interaction between the plurality of features and the one or more resilient arms prevents rotation of the actuator in the second rotational direction.

In a further embodiment, the invention can be an oral care dispenser comprising: a housing having a longitudinal axis and an internal reservoir containing a fluid; a collar non-rotatably coupled to the housing, the collar comprising an axial passageway, a segmented annular neck portion having an inner surface forming a first section of the axial passageway, a non-segmented annular body portion forming a second section of the axial passageway, and a plurality of protuberances extending radially inward from an inner surface of the non-segmented annular body portion; a drive component rotatably coupled to the collar, the drive component comprising a drive screw extending from the first annular flange in a first axial direction, a post extending from the first annular flange in a second axial direction and through the axial passageway, and at least one resilient arm extending radially outward from the post in the second section of the axial passageway; and wherein rotation of an actuator in a first rotational direction causes: (1) an'elevator to axially advance along the drive screw in the first axial direction to dispense the fluid from a dispensing orifice; and (2) the at least one resilient arm to move over the plurality of protuberances, the at least one resilient arm deforming when moving over each of the plurality of protuberances and resuming an original state upon passing each of the plurality of protuberances to generate an audible signal.

In certain exemplary embodiments, any suitable fluid may be used with embodiments and methods described herein according to the present invention. Accordingly, the oral care treatment system may be any type of system including without limitation tooth whitening, enamel protection, anti-sensitivity, fluoride, tartar protection/control, and others. The invention is expressly not limited to any particular type of oral care system or fluid, unless specifically claimed.

In still other embodiments, the invention can be an oral care system comprising: a toothbrush; and one of the aforementioned oral care dispensers, wherein the dispenser is configured to be detachably coupled to the toothbrush.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION OF THE INVENTION

Figure 1:
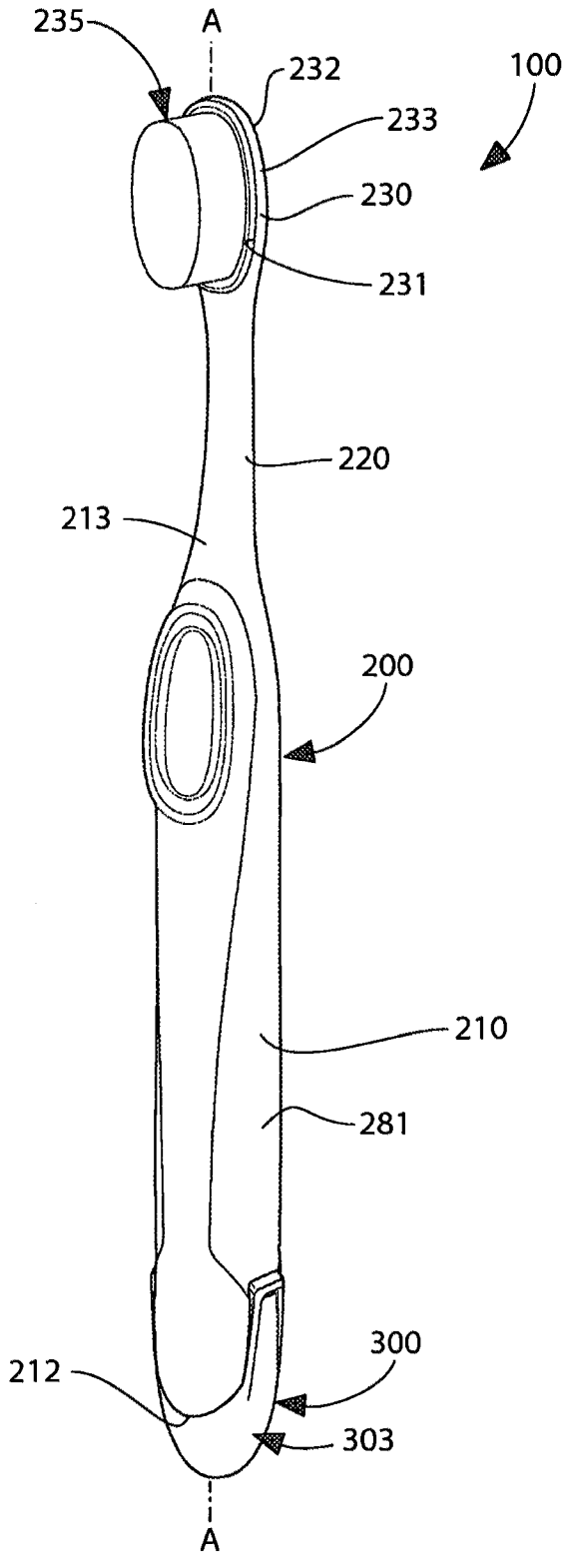
FIG. 1 is a front perspective view of an oral care system including a toothbrush and an oral care dispenser according to one embodiment of the present invention, wherein the oral care dispenser is detachably coupled to the toothbrush in the storage state.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above,"

"below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Exemplary embodiments of the present invention will now be described with respect to one possible oral care or treatment system. Embodiments of the oral care system may include without limitation the following fluids such as fluidic oral care materials including: tooth whitening, antibacterial, enamel protection, anti-sensitivity, anti-inflammatory, anti-attachment, fluoride, tartar control/protection, flavorant, sensate, colorant and others. However, other embodiments of the present invention may be used to store and dispense any suitable type of fluid and the invention is expressly not limited to any particular oral care system or fluidic oral care material alone.

Figure 2:
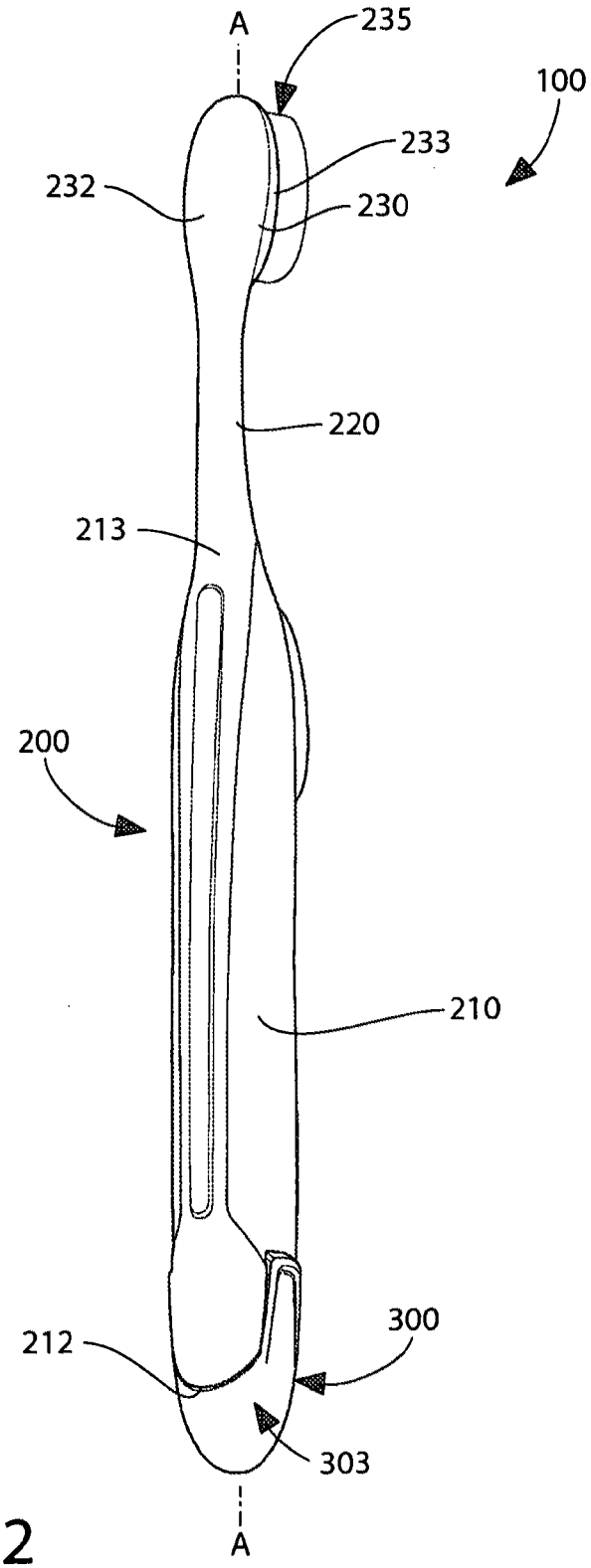
FIG. 2 is a rear perspective view of the oral care system of FIG. 1.
Figure 3:
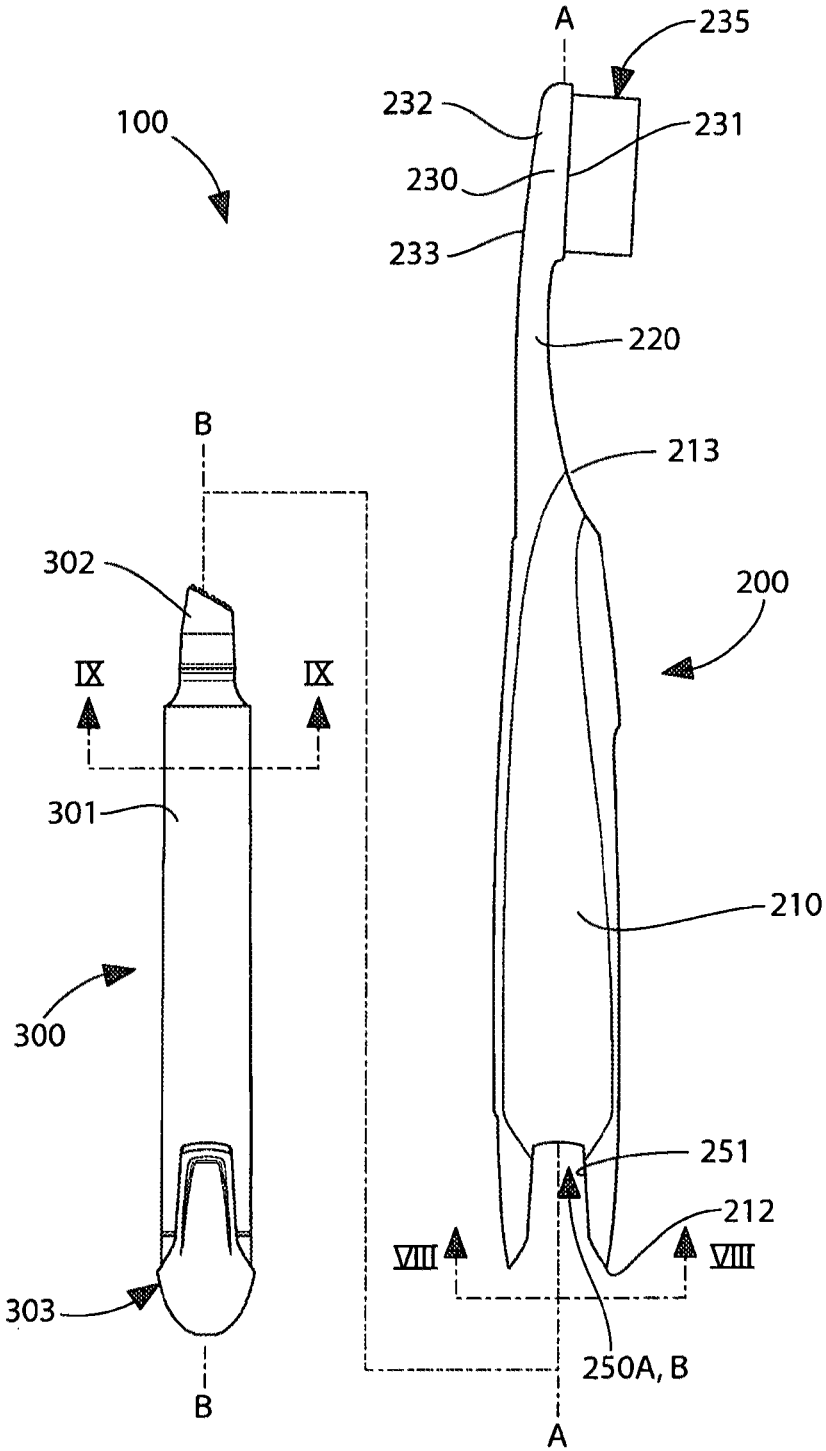
FIG. 3 is a left side view of the oral care system of FIG. 1, wherein the oral care dispenser is fully detached from the toothbrush and in an application state.

Referring to FIGS. 1-3 concurrently, an oral care system 100 is illustrated according to one embodiment of the present invention. The oral care system 100 is a compact readily portable self-contained user-friendly system that comprises all of the necessary components and chemistries necessary for a user to perform a desired oral care treatment routine. As will be described in greater detail below, the oral care system 100 in one exemplary embodiment comprises a modified toothbrush 200 having a removable oral care dispenser 300 disposed at least partially within its handle 210. Because the dispenser 300 is located within the handle 210 of the toothbrush 200, the oral care system 100 is portable for travel, easy to use, and reduces the amount of required storage space. Furthermore, since the toothbrush 200 and dispenser 300 are housed together, the user is less likely to misplace the dispenser 300 and more inclined to maintain the oral treatment routine with the dispenser 300 since brushing will remind the user to simply detach and apply the contents of the dispenser 300.

As discussed above, the oral care system 100 generally comprises the toothbrush 200 and the dispenser 300. While the invention is described herein with respect to the use of a toothbrush as one of the two primary components of the oral care system 100, it is to be understood that other alternate oral care implements can be used within the scope of the invention, including tongue cleaners, tooth polishers and specially designed ansate implements having tooth engaging elements. In still other embodiments, the invention can be the dispenser 300 in of itself and without including the toothbrush 200.

In certain instances, the toothbrush 200 may include tooth engaging elements that are specifically designed to increase the effect of the fluid in the dispenser on the teeth. For example, the tooth engaging elements may include elastomeric wiping elements that assist in removing stains from teeth and/or assist with forcing the fluid into the tubules of the teeth. Moreover, while the toothbrush 200 is exemplified as a manual toothbrush, the toothbrush may be a powered toothbrush in certain embodiments of the invention. It is to be understood that the inventive system can be utilized for a variety of intended oral care needs by filling the dispenser 300 with any fluid, such as an oral care agent that achieves a desired oral effect. In one embodiment, the fluid is free of (i.e., is not) toothpaste as the dispenser 300 is intended to augment not supplant the brushing regimen. The fluid can be selected to complement a toothpaste formula, such as by coordinating flavors, colors, aesthetics, or active ingredients.

The toothbrush 200 generally comprises a handle 210, a neck 220 and a head 230. The handle 210 provides the user with a mechanism by which he/she can readily grip and manipulate the toothbrush 200. The handle 210 may be formed of many different shapes, sizes and materials and may be formed by a variety of manufacturing methods that are well-known to those skilled in the art. Preferably, the handle 210 can house the dispenser 300. If desired, the handle 210 may include a suitable textured grip made of soft elastomeric material. The handle 210 can be a single or multi-part construction. The handle 210 extends from a proximal end 212 to a distal end 213 along a longitudinal axis A-A. An axial cavity (not shown) is formed within the handle 210. An opening 215 is provided at the proximal end 212 of the handle 210 that provides a passageway into the cavity through which the dispenser 300 can be inserted and retracted. While the opening 215 is located at the proximal end 212 of the handle 210 in the exemplified embodiment, the opening 215 may be located at other positions on the handle 210 in other embodiments of the invention. For example, the opening 215 may be located on a longitudinal surface of the handle 210 (e.g., the front surface, the rear surface and/or the side surfaces) and be elongated to provide sufficient access to the cavity 280.

The handle 210 transitions into the neck 220 at the distal end 213. While the neck 220 generally has a smaller transverse cross-sectional area than the handle 220, the invention is not so limited. Broadly speaking, the neck 220 is merely the transition region between the handle 210 and the head 230 and can conceptually be considered as a portion of the handle 210. In this manner, the head 230 is connected to the distal end 213 of the handle 210 (via the neck 220).

The head 230 and the handle 210 of the toothbrush 200 are formed as a single unitary structure using a molding, milling, machining or other suitable process. However, in other embodiments, the handle 210 and the head 230 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 230 and the handle 210 are of a unitary or multi-piece construction (including connection techniques) is not limiting of the present invention, unless specifically claimed. In some embodiments of the invention, the head 230 may be detachable (and replaceable) from the handle 210 using techniques known in the art.

The head 230 generally comprises a front surface 231, a rear surface 232 and a peripheral side surface 233 that extends between the front and rear surfaces 231, 232. The front surface 231 and the rear surface 232 of the head 230 can take on a wide variety of shapes and contours, none of which are limiting of the present invention. For example, the front and rear surfaces 231, 232 can be planar, contoured or combinations thereof. Moreover, if desired, the rear surface 232 may also comprise additional structures for oral cleaning or tooth engagement, such as a soft tissue cleaner or a tooth polishing structure. An example of a soft tissue cleaner is an elastomeric pad comprising a plurality of nubs and/or ridges. An example of a tooth polishing structure can be an elastomeric element, such as a prophy cup(s) or elastomeric wipers. Furthermore, while the head 230 is normally widened relative to the neck 220 of the handle 210, it could in some constructions simply be a continuous extension or narrowing of the handle 210.

The front surface 231 of the head 230 comprises a collection of oral cleaning elements such as tooth engaging elements 235 extending therefrom for cleaning and/or polishing contact with an oral surface and/or interdental spaces. While the collection of tooth engaging elements 235 is suited for brushing teeth, the collection of tooth engaging elements 235 can also be used to polish teeth instead of or in addition to cleaning teeth. As used herein, the term "tooth engaging elements" is used in a generic sense to refer to any structure that can be used to clean, polish or wipe the teeth and/or soft oral tissue (e.g. tongue, cheek, gums, etc.) through relative surface contact. Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth engaging elements 235 of the present invention can be connected to the head 230 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

The toothbrush 200 and the dispenser 300 are separate structures that are specially designed to be detachably coupled together when in an assembled state (referred to herein as a storage state) and completely isolated and separated from one another when in a disassembled state (referred to herein as an application state). The toothbrush 200 and the dispenser 300 are illustrated in the storage state in FIGS. 1-2 and in the application state in FIG. 3. The dispenser 300 can be slidably manipulated and altered between the storage state (FIGS. 1-2) in which the dispenser 300 is located (or docked) in the toothbrush handle 210 and the application state (FIG. 3) in which the dispenser 300 is removed from the handle 210 by the user as desired.

Figure 4:
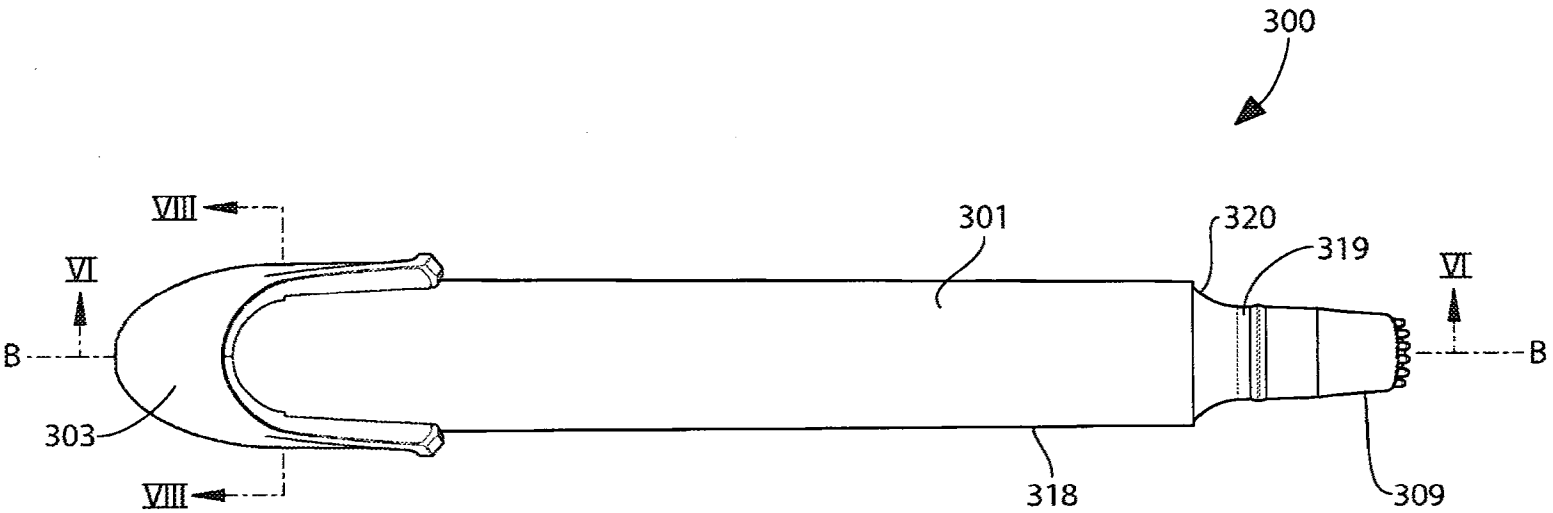
FIG. 4 is a side view of an oral care dispenser according to an embodiment of the present invention.
Figure 5:
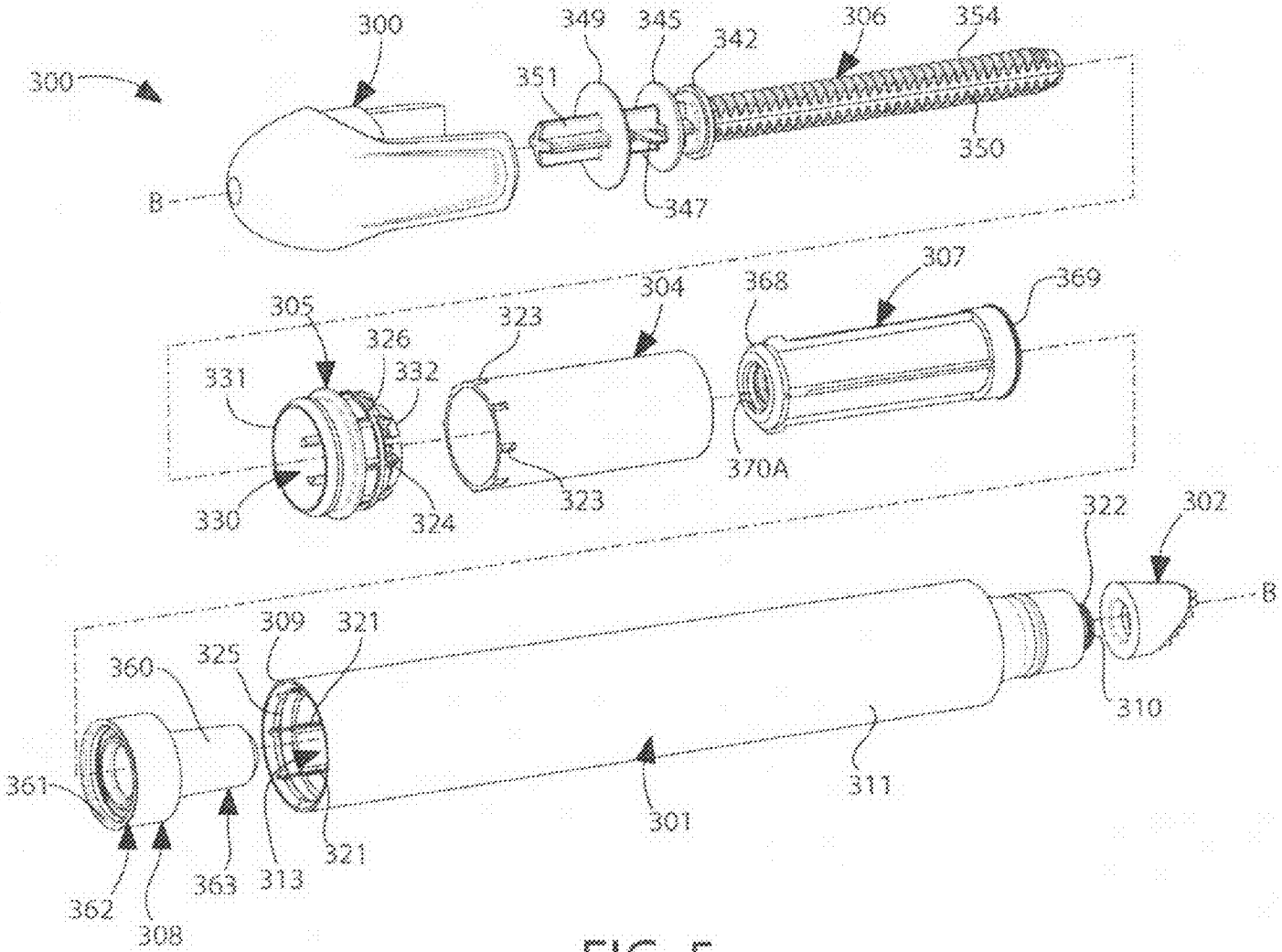
FIG. 5 is an exploded view of the oral care dispenser of FIG. 4
Figure 6:
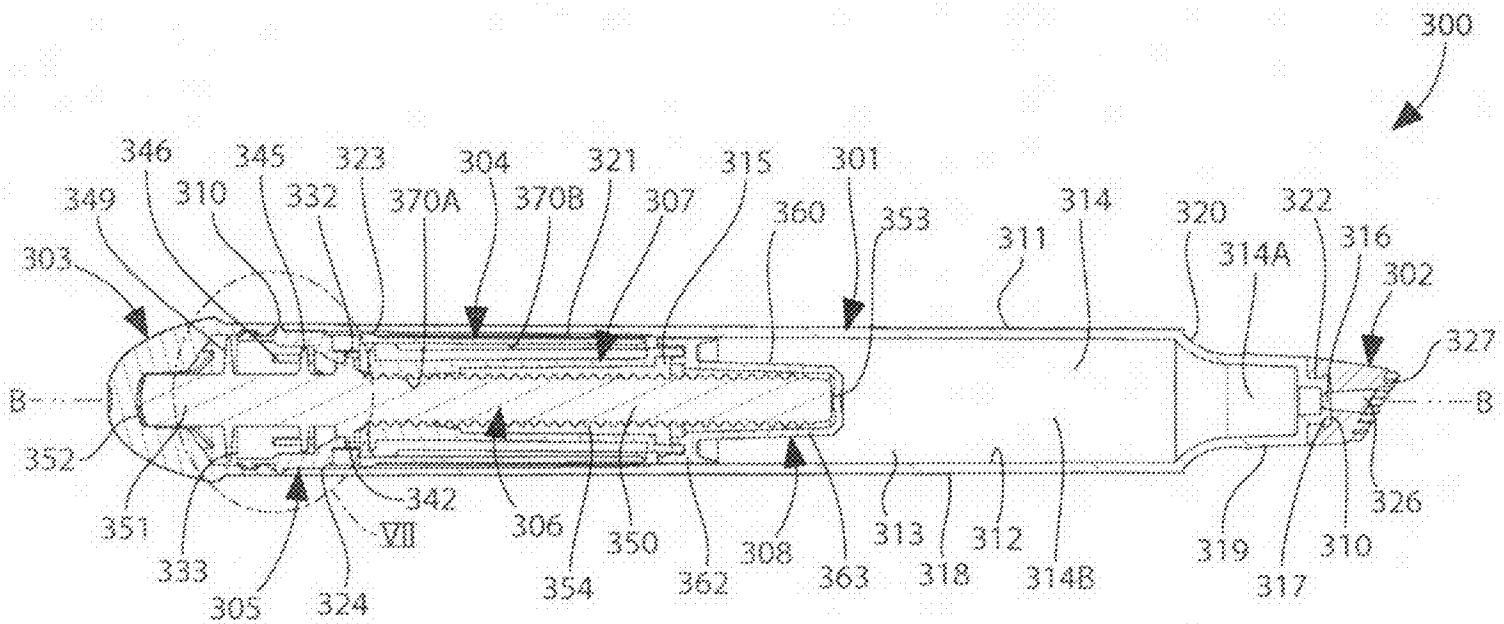
FIG. 6 is a longitudinal cross-sectional view of the oral care dispenser of FIG. 4 taken along the longitudinal axis B-B.

Referring now to FIGS. 4-6 concurrently, the dispenser 300 is schematically illustrated. The dispenser 300 is an elongated tubular pen-like structure that extends along longitudinal axis B-B. The dispenser 300 generally comprises a housing 301, an applicator 302 coupled to one end of the housing 301, and an actuator 303 extending from an opposite end of the housing 301. The actuator 303 protrudes axially from the housing 301 so that a user can easily grip and rotate the actuator 303. The dispenser 300 is designed so as to be capable of being operated to dispense the fluid stored therein using a single hand. Specifically, the dispenser is positioned in a user's hand so that the actuator 303 is lodged in the palm of the user's hand. The user then uses the fingers of that same hand to rotate the housing 301 (while keeping the actuator 303 stationary relative to the housing 301). As a result, the fluid contained therein is dispensed from the dispenser 300. The dispensing sub-system will be described in greater detail below.

The dispenser 300 generally comprises a housing 301, the applicator 302, the actuator 303, an anti-rotation sleeve 304, a collar 305, a drive component 306, an extension member 307, and an elevator 308. The housing 301 will be described first in greater detail.

Figure 8:
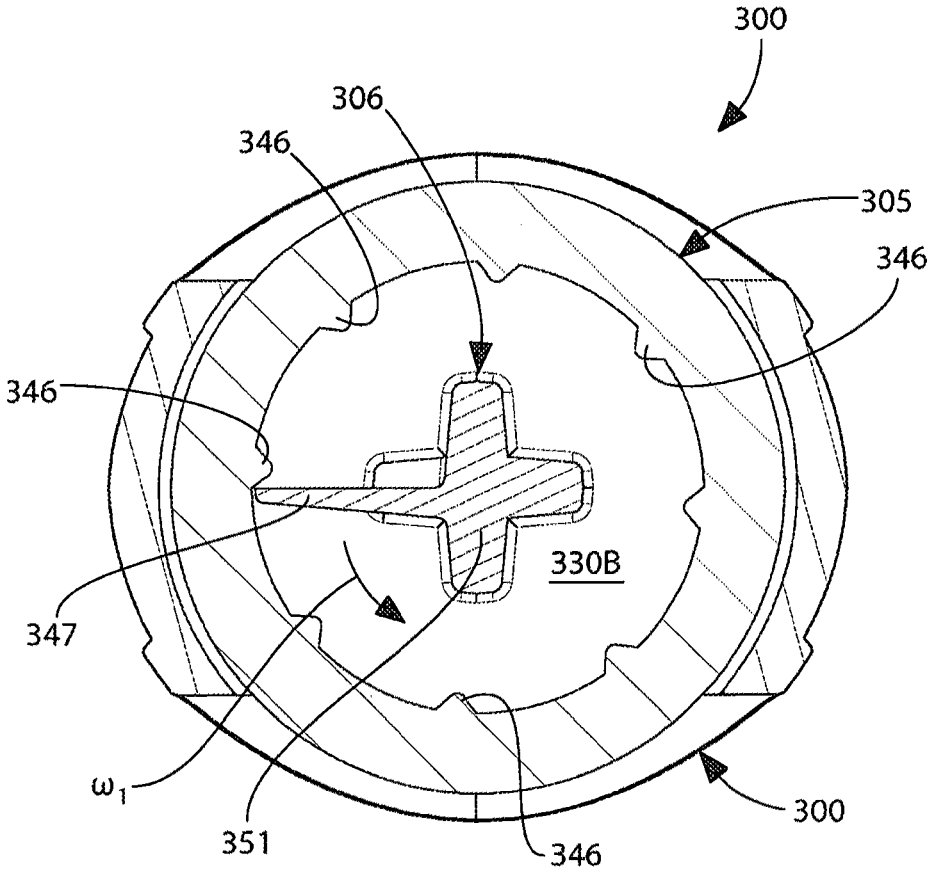
FIG. 8 is a transverse cross-sectional view of the oral care dispenser of FIG. 4 taken along view VII-VII of FIG. 5.
Figure 9:
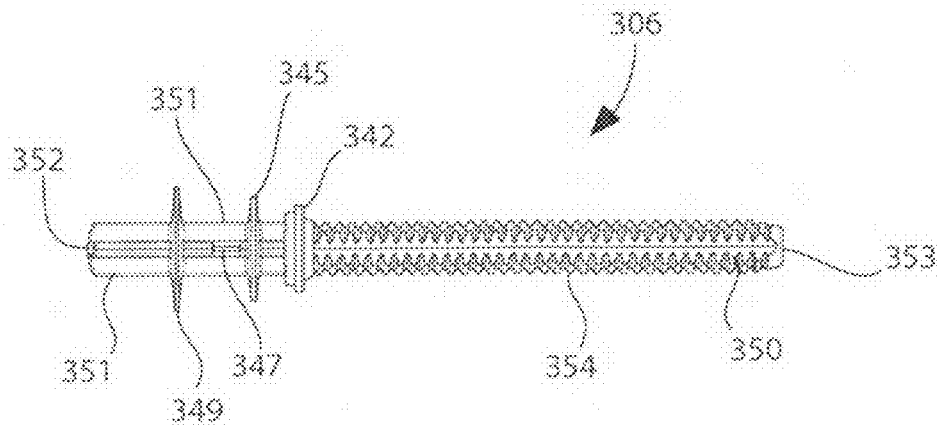
FIG. 9 is a side view of the drive component of the oral care dispenser of FIG. 4 according to an embodiment of the present invention.
Figure 10:
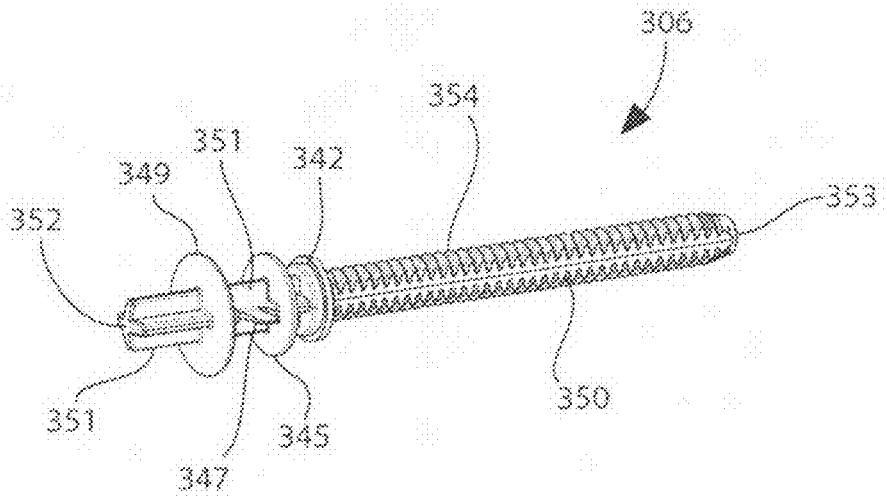
FIG. 10 is a perspective view of the drive component of FIG. 9.
Figure 11A:
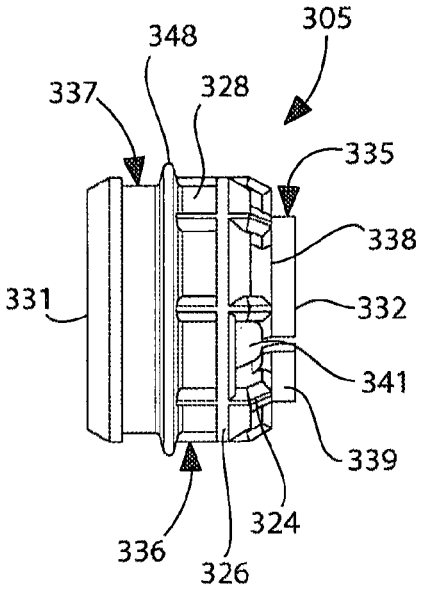
FIG. 11A is a side view of the collar of the oral care dispenser of FIG. 4 according to an embodiment of the present invention.
Figure 11B:
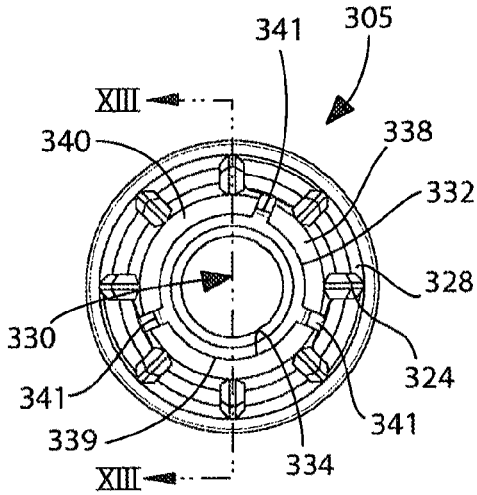
FIG. 11B is a top view of the collar of FIG. 11A.
Figure 12A:
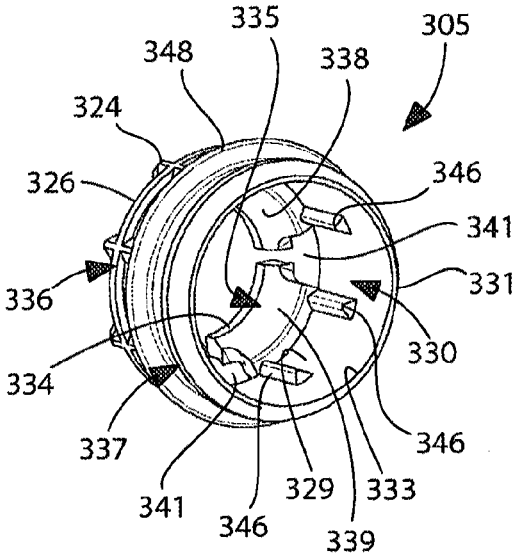
FIG. 12A is a bottom perspective view of the collar of FIG. 11A.
Figure 12B:
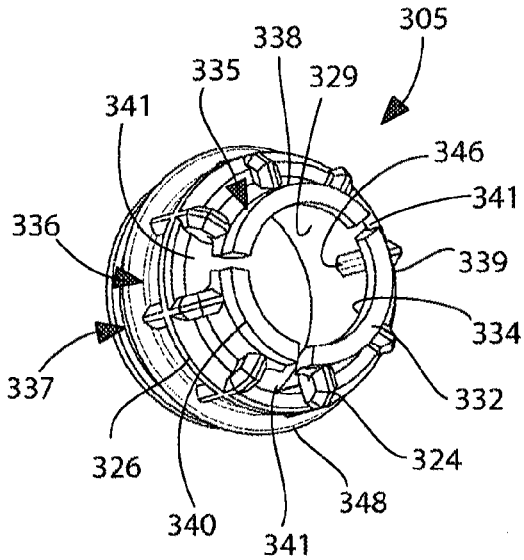
FIG. 12B is a top perspective view of the collar of FIG. 11A.
Figure 13:
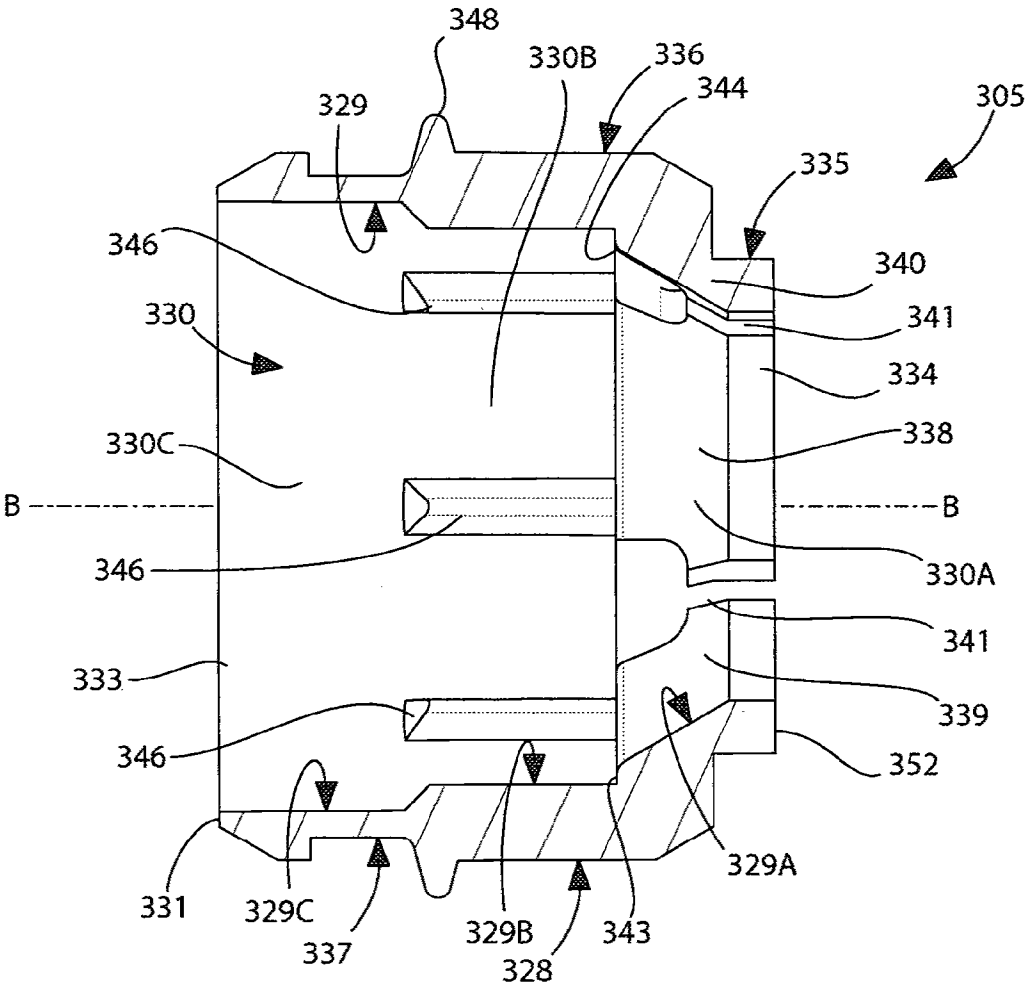
FIG. 13 is a longitudinal cross-sectional view of the collar of FIG. 11A taken along the longitudinal axis B-B.

The housing 301 has a circular transverse cross-sectional profile (shown in FIG. 8). Of course, in other embodiments, the housing 301 can take non-circular transverse cross-sectional shapes as desired. The housing 301 is constructed of a material that is sufficiently rigid to provide the necessary structural integrity for the dispenser 300. For example, the housing 301 can be formed of a moldable hard plastic. Suitable hard plastics include polymers and copolymers of ethylene, propylene, butadiene, vinyl compounds and polyesters such as polyethylene terephthalate. The chosen plastic(s), however, should be compatible with the fluid that is to be stored within the dispenser 300 and should not be corroded or degraded by the oral care agents.

While the housing 301 is exemplified as a single layer construction, in certain embodiments, the housing may be a multi-layer construction. In certain multi-layer embodiments, an inner layer can be formed from the hard plastic materials described immediately above while an outer layer can be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness. While an over-molding construction is one suitable method of forming the outer layer, a suitable deformable thermoplastic material, such as TPE, may be formed in a thin layer and attached to inner layer with an appropriate adhesive, sonic welding, or by other means.

The housing 301 is an elongated hollow tubular structure extending along the longitudinal axis B-B from a proximal end 309 to a distal end 310. The housing 301 comprises an outer surface 311 and an inner surface 312 that forms an elongated internal cavity 313. As discussed in greater detail below, when the dispenser 300 is fully assembled, the internal cavity 313 of the housing 301 is divided into a reservoir 314 and a chamber 315 by the elevator 308. A dispensing orifice 316 is provided in the distal end 310 of the housing 301 through which fluid stored in the reservoir 314 is dispensed from the dispenser 300. In the exemplified embodiment, the dispensing orifice 316 is located in a transverse end wall 317 at the distal end 316 of the housing 301. In certain other embodiments, the dispensing orifice 316 can be located in other areas of the housing 301, such as on one of the side walls.

The housing 301 comprises a first longitudinal section 318 and a second longitudinal section 319. The second longitudinal section 319 has a reduced transverse cross-section in comparison to the first longitudinal section 318. The second longitudinal section 319 extends axially from an annular shoulder 320 of the housing 301. The reservoir 314 occupies both a distal section of the first longitudinal section 318 and the second longitudinal section 319. The chamber 318, on the other hand, occupies only a proximal section of the first longitudinal section 318. As a result of the reservoir 314 occupying both a distal section of the first longitudinal section 318 and the second longitudinal section 319, the reservoir 314 comprises a section 314A located within the second longitudinal section 319 that has a reduced transverse cross-section in comparison to the section 314B of the reservoir 314 located within the distal section of the first longitudinal section 318.

The second longitudinal section 319 of the housing 301 comprises a plug portion 322 for facilitating coupling of the applicator 302 to the housing 301. Of course, the applicator 302 can be coupled to the housing 301 in a wide variety of manners. A plurality of circumferentially spaced-apart grooves 321 are formed in the inner surface 312 of the housing 301. The grooves 321 are located within the chamber 315 of the internal cavity 313 and extend axially from the proximal end 310. The grooves 321 are provided to receive corresponding radial flanges 323 of the anti-rotation sleeve 304 when the dispenser 300 is assembled to prevent relative rotation between the anti-rotation sleeve 304 and the housing 301 (which in turn prevents relative rotation between the extension member 307 and the housing 301 and between the elevator 308 and the housing 301). Moreover, a portion of the grooves 321 closest to the proximal end 309 of the housing 301 receive corresponding radial flanges 324 of the collar 305 when the dispenser 300 is assembled to prevent relative rotation the collar 305 and the housing 301.

A plurality of circumferential grooves 325 are also provided on the inner surface 312 of the housing 301. The circumferential grooves 325 are located near the proximal end 309 of the housing 301 and receive corresponding annular ribs 326 of the collar 305 when the dispenser 300 is assembled, thereby preventing axial separation of the collar 305 from the housing 301 when subjected to an axially applied force and/or movement.

The applicator 302, in the exemplified embodiment, is formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness.

In alternative embodiments, the applicator 302 may be constructed of bristles, a porous or sponge material, or a fibrillated material. Suitable bristles include any common bristle material such as nylon or PBT. The sponge-like materials can be of any common foam material such as urethane foams. The fibrillated surfaces can be comprised of various thermoplastics. The invention, however, is not so limited and the applicator 302 can be any type of surface and/or configuration that can apply a viscous substance onto the hard surface of teeth, including merely an uncovered opening/orifice.

A dispensing orifice 326 is provided in the applicator 302 through which fluid from the reservoir 314 can be dispensed. When the applicator 302 is coupled to the second longitudinal section 319 of the housing 301, the dispensing orifice 326 of the applicator 302 is aligned with the dispensing orifice 316 of the housing 301. The working surface 327 of the applicator 302 has a tri-lobe shape in the exemplified embodiment but can take on other shapes as desired.

Referring now to FIGS. 7, 11A-B, 12A-B and 13 concurrently, the collar 305 will be described in greater detail. The collar 305 is constructed of a material that is sufficiently rigid to provide the necessary structural integrity to perform the functions discussed below. In one embodiment, the collar 305 can be formed of a moldable hard plastic. Suitable hard plastics include polymers and copolymers of ethylene, propylene, butadiene, vinyl compounds and polyesters such as polyethylene terephthalate.

In the exemplified embodiment, the collar 305 is an annular ring-like structure comprising an outer surface 328 and an inner surface 329. The inner surface 329 forms an axial passageway 330 that extends through the entirety of the collar 305. The axial passageway 330 extends along the longitudinal axis B-B so that the drive component 306 can be extended there through as discussed in greater detail below. The collar 305 extends along the longitudinal axis B-B from a proximal edge 331 to a distal edge 332. The proximal edge 332 defines an opening 333 into the axial passageway 330 while the distal edge 332 defines an opening 334 into the axial passageway 330.

The collar 305 comprises a neck portion 335, a body portion 336 and a flange portion 337. The neck portion 335 is a segmented annular structure that axially protrudes from the body portion 336. In the exemplified embodiment, the neck portion 335 is formed by a Plurality of arcuate segments 338-340 that protrude axially from the plug portion 336 and circumferentially surround a first section 330A of the axial passageway 330 (and a portion of the drive component 306 when the dispenser 300 is assembled). Adjacent arcuate segments 338-340 are separated by a gap 341.

Figure 7:
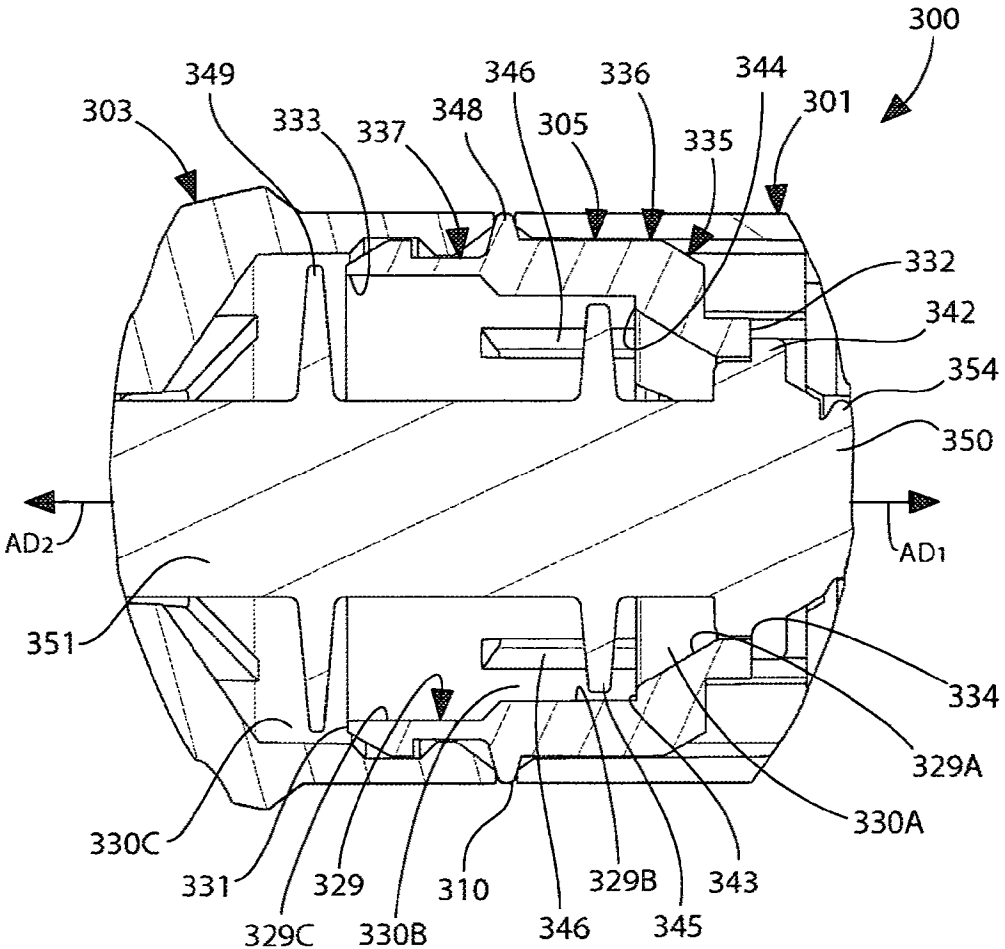
FIG. 7 is a close-up view of area VI of FIG. 6.

The neck portion 335 is formed by spaced-apart segments 338-340 to provide radial flexibility to the neck portion 335 so that a first annular flange 342 of the drive component 306 can pass through the neck portion 338 during assembly. During assembly, as the first annular flange 342 of the drive component 306 passes through the neck portion 335, the segments 338-340 flex radially outward, thereby allowing the first annular flange 342 to pass there through when moved in a first axial direction (indicated by arrow $AD_1$ in FIG. 7). However, once the first annular flange 342 of the drive component 306 has passed through the neck portion 335, the segments 338-340 snap radially inward, returning to their original position and preventing the drive component 306 from being separated from the collar 305. More specifically, once the first annular flange 342 of the drive component 306 has passed through the neck portion 335 and is adjacent the distal edge 332 of the collar 305 (as shown in FIG. 7), contact between the distal edge 332 of the neck portion 335 and the first annular flange 342 prohibits the first annular flange 342 from passing back through the opening 334 defined by the distal edge 332 of the neck portion 335. Thus, the drive component 306 cannot be translated a substantial distance in a second axial direction (indicated by arrow $AD_2$ in FIG. 7) relative to the collar 305. In other alternate embodiments, the neck portion 335 may be constructed as a non-segmented annular structure.

The neck portion 335 comprises an inner surface 329A (which is conceptually an axial section of the overall inner surface 329 of the collar 305). The inner surface 329A of the neck portion 335 forms a first section 330A of the axial passageway 330. In the exemplified embodiment, the inner surface 329A of the neck portion 335 is obliquely oriented to the longitudinal axis B-B. As a result, the first section 330A of the axial passageway 330 has a first transverse cross-sectional area that tapers toward the distal edge 332. The oblique orientation of the inner surface 329A of the neck portion acts as a chamfered surface that helps guide the first annular flange 342 of the drive component 306 during assembly of the dispenser 300 and also assists with achieving the above-described radial flexure of the arcuate segments 338-340.

The body portion 336 of the collar 305 is a non-segmented annular structure having an inner surface 329B (which is conceptually an axial section of the overall inner surface 329 of the collar 305). The inner surface 329B of the body portion 336 forms a second section 330B of the axial passageway 330. In the exemplified embodiment, the inner surface 329B of the body portion 336 is substantially parallel to the longitudinal axis B-B. The second section 330B of the axial passageway 330 has a second transverse cross-sectional area that is greater than the first transverse cross-sectional area of the first section 330A of the axial passageway 330 at all points. Thus, the body portion 336 does not prohibit or otherwise interfere with the insertion of the first annular flange 342 of the drive component 306 during assembly.

The collar 305, in the exemplified embodiment, further comprises an annular shoulder portion 343 between the neck portion 335 and the body portion 336. The annular shoulder portion 343 defines an opening 344 that leads from the second section 330B of the axial passageway 330 to the first section 330A of the axial passageway 330. As described in greater detail below, the opening 344 defining the annular shoulder portion 343 of the collar 305 is sized so that a second annular flange 345 of the drive component 306 cannot fit through said opening 344. Such obstruction prevents over-insertion of the drive component 306 through the collar 305 during assembly.

The body portion 336 of the collar 305 further comprises a plurality of protuberances 346 extending radially inward from the inner surface 329B of the body portion 336 into to the second section 330B of the axial passageway 330 (also shown in FIG. 8). The plurality of protuberances 346 are arranged on the inner surface 329B of the body portion 336 in a circumferentially equally-spaced manner about the longitudinal axis B-B. In the exemplified embodiment, the plurality of protuberances 346 are in the form of linear axially extending ridges. However, in alternate embodiments of the invention, the plurality of protuberances 346 can be, without limitation, nubs, bumps, cones, curved ridges or combinations thereof. As described in greater detail below with respect to FIG. 8, the plurality of protuberances 346 are provided to interact and cooperate with the resilient arm(s) 347 of the drive component 306 when the dispenser 300 is assembled to provide an audible signal and/or prohibit rotation of the actuator 303 in a second rotational direction. However, in certain alternate embodiments of the invention, the desired audible signal generation and/or prohibition of the actuator 303 being rotated in the second rotational direction can be achieved by replacing the plurality of protuberances 346 with other topographical features on the body portion 336 of the collar 305. For example, in one such embodiment, the topographical features could take the form of a plurality of circumferentially spaced-apart depressions.

As mentioned above, the body portion 336 of the collar 305 is a non-segmented annular structure. Such a non-segmented annular structure can be beneficial for operation of the dispenser 300 over time because the body portion 336 has increased structural integrity that is more capable of withstanding the repetitive axial forces imparted by the resilient arm(s) 347 of the drive component 306 to the body portion 306 during the interaction with the plurality of protuberances 346. Moreover, by providing the plurality of protuberances 336 on a non-segmented annular structure that does not have to flex to allow passage of the first annular flange 342 of the drive component 306 during assembly, there is a decreased chance of the plurality of protuberances 336 being damaged during assembly. Moreover, there is no danger that the structure on which the plurality of protuberances 336 are located (i.e., the body portion 336) will become unintentionally weakened and/or permanently deformed during passage of the first annular flange 342 of the drive component 306 during assembly.

The collar 305 further comprises a flange portion 337. The flange portion 337 comprises the proximal edge 331 of the collar 305 and, thus, the opening 333 into the axial passageway 330. The flange portion 337 also comprises an inner surface 329C (which is conceptually an axial section of the overall inner surface 329 of the collar 305). The inner surface 329C of the flange portion 337 forms a third section 330C of the axial passageway 330. In the exemplified embodiment, the inner surface 329C of the body portion 337 is substantially parallel to the longitudinal axis B-B. The third section 330C of the axial passageway 330 has a third transverse cross-sectional area that is greater than the second transverse cross-sectional area of the second section 330B of the axial passageway 330 at all points. Thus, the flange portion 337 does not prohibit or otherwise interfere with the insertion of the second annular flange 342 of the drive component 306 into the second section 330B of the axial passageway 330 during assembly.

The flange portion 337 also comprises an annular ridge 348 protruding from the outer surface 328 of the collar 305. The annular ridge 348 acts as flange or stopper that prevents over-insertion of the collar 305 into the housing 301 during assembly of the dispenser 300. When the collar 303 is coupled to the housing 301, the annular ridge 348 is in abutment with the proximal end 310 of the housing 301 so that the flange portion 348 protrudes from the proximal end 310 of the housing 301 while the neck and body portions 335, 336 are located within the housing 301.

As mentioned above, the flange portion 337 comprises the proximal edge 331 of the collar 305 that defines the opening 333. The opening 333 is sized so that when the dispenser 300 is assembled, a third annular flange 349 of the drive component 306 cannot fit through the opening 333. Thus, the third annular flange 349 is located adjacent to the proximal edge 331 of the collar 305 but outside of the axial passageway 330.

When the dispenser 300 is assembled, the collar 305 is coupled to the housing 301 as best illustrated in FIGS. 5 and 6. When the dispenser 300 is assembled, the body portion 336 and the neck portion 335 of the collar 305 are disposed within the internal cavity 313 (specifically chamber 315) of the housing 301. The flange portion 337 abuts the proximal end 310 of the housing 301, thereby preventing over-insertion of the collar 305 into the internal cavity 313. When coupled to the housing 301, the collar 305 is non-rotatable with respect to the housing 301. Of course, cooperative structures and connection techniques other than those described herein can be used to couple the collar 305 to the housing 301 so that relative rotation between the two is prohibited.

Furthermore, while the collar 305 is a separate component than the housing 301 in the exemplified embodiment of the dispenser 300, in other embodiments the collar 305 (or portions thereof) can be integrally formed as a part of the housing 301. In such an embodiment, the housing 301 itself would comprise the structure of the collar 305 described above.

Referring now to FIGS. 5-7 and 9-10 concurrently, the drive component 306 will be explained in greater detail. The drive component 306 generally comprises a drive screw 350, a post 351, the resilient arm 345 extending radially outward from the post 351, the first annular flange 342, the second annular flange 345 and the third annular flange 349. In the exemplified embodiment, the drive component 306 is integrally formed as a single unitary structure. However, in certain alternate embodiments, the drive screw 350, the post 351, the resilient arm 347, and the annular flanges 342, 345, 349 can be formed as separate components that are subsequently coupled together and/or properly positioned within the dispenser 300 in a cooperative manner.

The drive component 306 (and its constituent components) is constructed of a material that is sufficiently rigid to provide the necessary structural integrity to perform the functions discussed below. In one embodiment, the drive component 306 can be formed of a moldable hard plastic. Suitable hard plastics include polymers and copolymers of ethylene, propylene, butadiene, vinyl compounds and polyesters such as polyethylene terephthalate.

The drive component 306 extends from a proximal end 352 to a distal end 353 along the longitudinal axis B-B. The first, second and third annular flanges 342, 345, 349 are located in a spaced apart manner along the axial length of the drive component 306. The first annular flange 342 is located at a transition between the drive screw 350 and the post 351 and extends radially outward therefrom to form a transverse extending structure. The second and third annular flanges 345, 349 are located on the post 351 and extend radially outward therefrom to form transverse extending structures. While each of the first, second and third annular flanges 342, 345, 349 are non-segmented annular plates in the exemplified embodiments, the first, second and/or third annular flanges 342, 345, 349 can take on other structures in alternate embodiments. For example, the first, second and/or third annular flanges 342, 345, 349 can be formed by a plurality circumferentially spaced-apart finger-like flanges or can be a single finger-like flange.

The drive screw portion 350 extends axially from the first annular flange 342 in the first axial direction $AD_1$ along the longitudinal axis B-B while the post 351 extends axially from the first annular flange 342 in the second axial direction $AD_2$ along the longitudinal axis B-B. The drive screw 350 and the post 351 are in axial alignment with one another along the longitudinal axis B-B. The drive screw 311 is threaded as is known in the art and, thus comprises a segmented helical ridge 354 for facilitating axial advancement of the elevator 308 through the reservoir 314 to dispense fluid from the dispenser. The pitch of the segmented helical ridge 354 is selected so that the elevator 308 axially advances toward the dispensing orifice 316 a desired distance upon the drive component 306 being rotated a predetermined rotational angle, thereby dispensing a pre-selected volume of the fluid from the reservoir 314.

The resilient arm 347 is located on the post 351 at an axial position between the second and third annular flanges 345, 349. While only a single resilient arm 347 is utilized in the exemplified embodiment, a plurality of the resilient arms 347 can be provided on the post 351 as desired. In such an embodiment, the resilient arms 347 will be arranged in a circumferentially spaced-apart manner about the post 351 at the same axial location between the second and third annular flanges 345, 349. In the exemplified embodiment, the resilient arm 347 is a straight/linear prong extending radially outward from the post 351. However, in alternate embodiments, the resilient arm 347 can take on other shapes, such as the curved prongs shown in FIGS. 14-15. The function of the resilient arm 347 will be described in greater detail below.

Referring now to FIGS. 6 and 7 concurrently, when the dispenser 300 is assembled, the drive component 306 is rotatable with respect to the housing 301. More specifically, the drive component 306 is rotatably coupled to the collar 305. The actuator 303, in turn, is non-rotatably coupled to the proximal end 352 of the drive component 306 so that rotation of the actuator 303 correspondingly rotates the drive component.

The drive component 306 extends through the axial passageway 330 of the collar 305 and into the chamber 315 of the internal cavity 313. More specifically, the post 351 is disposed within and extends through the axial passageway 330 of the collar 305 while the drive screw 350 is located distally beyond the collar 305. When so assembled, the first annular flange 342 of the drive component 306 is located adjacent the distal edge 332 of the collar 305 but distally beyond and outside of the collar 305. The first annular flange 342 cannot pass back through the opening 334 defined by the distal edge 332 of the neck portion 335 due to contact between the distal edge 332 of the neck portion 335 and the first annular flange 342.

The second annular flange 345 of the drive component 306 is located adjacent the annular shoulder portion 343 of the collar 305 in the second section 330B of the axial passageway 330. Thus, the neck portion 335 of the collar 305 is located between the first annular flange 342 and the second annular flange 345. The third annular flange 349 of the drive component 306 is located adjacent the proximal edge 331 of the collar 305.

The second annular flange 345 is sized and/or shaped so that it cannot fit through the opening 344 defined by the annular shoulder portion 343. As a result, contact between the annular shoulder portion 343 of the collar and the second annular flange 345 prevents over-insertion of the drive component 306 into the collar 305 during assembly. In one embodiment, the opening 344 defined by the annular shoulder portion 343 has a first diameter while the first annular flange 342 has a second diameter and the second annular flange 345 has a third diameter. The first diameter is greater than the second diameter and less than the third diameter. Thus, the first annular flange 342 can pass through the opening 344 of the annular should portion 343 while the second annular flange 345 is prohibited from doing so.

Similarly, the third annular flange 349 is sized and/or shaped so that it cannot fit through the opening 333 defined by the proximal edge 331 of the collar 305. In one such embodiment, the opening 333 defined by the proximal edge 331 of the collar 305 has a fourth diameter while the third annular flange 349 has a fifth diameter. The fifth diameter is greater than the fourth diameter. The fourth diameter of the opening 333 is greater than the third diameter of the second annular flange 345.

The resilient arm 347 of the drive component 306 is located within the body portion 336 of the collar 305. More specifically, the resilient arm 347 of the drive component 306 is located between the second and third annular flanges 345, 349 and within the second section 330B of the axial passageway 330. As discussed below with respect to FIG. 8, the resilient arm 347 of the drive component 306 is positioned to interact with the plurality of protuberances 346 on the inner surface 329B of the body portion 336.

The post 351 of the drive component 306 protrudes from the flange portion 337 of the collar 305 in the second axial direction $AD_2$. Thus, the protruding portion of the post 351 provides a structure by which the actuator 303 can be non-rotatably coupled to the drive component 306. The actuator 303 is also rotatably coupled to the flange portion 337 of the collar 305. The actuator 303 is located at the proximal end 352 of the drive component 306. When the dispenser 300 is assembled the actuator 303 protrudes axially beyond the proximal end 310 of the housing 301.

Referring now to FIGS. 5 and 6 concurrently, the elevator 308, the extension member 307 and the anti-rotation sleeve 304 will be described in greater detail. Each of the elevator 308, the extension member 307 and the anti-rotation sleeve 304 is constructed of a material that is sufficiently rigid to provide the necessary structural integrity to perform the functions discussed below. In one embodiment, each of the extension member 307 and the anti-rotation sleeve 304 can be formed of a moldable hard plastic. Suitable hard plastics include polymers and copolymers of ethylene, propylene, butadiene, vinyl compounds and polyesters such as polyethylene terephthalate. Furthermore, in certain embodiments the elevator 308 can be formed of a moldable relatively softer plastic material such as linear low density polyethylene.

The elevator 308 is disposed within the internal cavity 313 of the housing 301, thereby dividing the internal cavity 313 into a reservoir 314 and a chamber 315. The reservoir 314 contains the desired fluid or product, which can be any active or inactive oral care agent. The oral care agent and/or its carrier may be in any form such as a solid or a flowable material including without limitation viscous pastes/gels or less viscous liquid compositions. The fluid is a flowable material having a low viscosity in certain embodiments. Any suitable fluid can be used in the present invention. For example, the fluid may include oral care agents such as whitening agents, including without limitation, peroxide containing tooth whitening compositions. Suitable peroxide containing tooth whitening compositions are disclosed in U.S. patent Ser. No. 11/403,372, filed Apr. 13, 2006, to the present assignee, the entirety of which is hereby incorporated by reference. While a tooth whitening agent and a sensitivity agent are the exemplified active agents in the present invention, any other suitable oral care agents can be used with embodiments of the present invention as the fluid and, thus, be stored within the reservoir 317. Contemplated fluids include oral care agents that can be an active or non-active ingredient, including without limitation, antibacterial agents; oxidative or whitening agents; enamel strengthening or repair agents; tooth erosion preventing agents; anti-sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents; anti-inflammatory agents; dry mouth relief ingredients; catalysts to enhance the activity of any of these agents; colorants or aesthetic ingredients; and combinations thereof. The fluid in one embodiment is free of (i.e., is not) toothpaste. Instead, the fluid is intended to provide supplemental oral care benefits in addition to merely brushing one's teeth. Other suitable fluids could include lip balm or other materials that are typically available in a semi-solid state.

In some embodiments, the materials useful in the fluid contained in the reservoir may include oral care compositions comprising a basic amino acid in free or salt form. In one embodiment, the basic amino acid may be arginine. Various formulations would be useful to supply the arginine to the user. One such oral care composition, e.g., a dentifrice, may be used comprising:

i. an effective amount of a basic amino acid, in free or salt form, e.g., arginine, e.g., present in an amount of at least about 1%, for example about 1 to about 30%; by weight of total formulation, weight calculated as free base;

ii. an effective amount of fluoride, e.g., a soluble fluoride salt, e.g., sodium fluoride, stannous fluoride or sodium monofluorophosphate, providing from about 250 to about 25,000 ppm fluoride ions, e.g., about 1,000 to about 1,500 ppm; and iii. an abrasive, e.g., silica, calcium carbonate or dicalcium phosphate.

The dental treatment materials of the present invention may have a viscosity suitable for use in tooth treatment applications and methods. As used herein, the "viscosity" shall refer to "dynamic viscosity" and is defined as the ratio of the shearing stress to the rate of deformation as measured by AR 1000-N Rheometer from TA Instruments, New Castle, Del.

When measured at a shear rate of 1 seconds$^{-1}$, the viscosity may have a range with the lower end of the range generally about 0.0025 poise, about 0.1 poise, and more specifically about 75 poise, with the upper end of the range being selected independently of the lower end of the range and generally about 10,000 poise, specifically about 5,000 poise, and more specifically about 1,000 poise. Non-limiting examples of suitable Viscosity ranges when measured at a shear rate of 1 seconds$^{-1}$ includes, about 0.0025 poise to about 10,000 poise, about 0.1 poise to about 5,000 poise, about 75 poise to about 1000 poise, and about 0.1 poise to about 10,000 poise.

When measured at a shear rate of 100 seconds$^{-1}$, the viscosity will have a range with the lower end of the range generally about 0.0025 poise, specifically about 0.05 poise, and more specifically about 7.5 poise, with the upper end of the range being selected independently of the lower end of the range and generally about 1,000 poise, specifically about 100 poise, and more specifically about 75 poise. Non-limiting examples of suitable viscosity ranges when measured at a shear rate of 100 seconds.sup.31 1 includes, about 0.0025 poise to about 1,000 poise, about 0.05 poise to about 100 poise, about 7.5 poise to about 75 poise, and about 0.05 poise to about 1,000 poise.

When measured at a shear rate of 10,000 seconds$^{-1}$, the viscosity will have a range with the lower end of the range generally about 0.0025 poise, specifically about 0.05 poise, and more specifically about 5 poise, with the upper end of the range being selected independently of the lower end of the range and generally about 500 poise, specifically about 50 poise. Non-limiting examples of suitable viscosity ranges when measured at a shear rate of 10,000 seconds$^{-1}$ includes, about 0.0025 poise to about 500 poise, about 0.05 poise to about 50 poise, about 5 poise to about 50 poise, and about 0.05 poise to about 500 poise.

Each of the formulations contains a viscosity agent that adjusts the viscosity of the formulation to a level which permits effective flow from the reservoir 317, through the dispensing orifice 319 of the housing 301, and out of the dispensing orifice 326 of the applicator 302. This agent may be water, thickeners or thinners. The viscosity should be adjusted in relationship to the dimensions of the dispensing orifice 319 (including length, internal transverse cross-sectional area, shape, etc.), the composition of the applicator 302 or other delivery channel used (i.e., hollow channel, porous channel, etc.), and the amount of force available to pressurize the reservoir 317.

The elevator 308 forms a hermetic seal between the reservoir 314 and the chamber 313. An upper surface 360 of the elevator 308 forms a lower end wall of the reservoir 314 while a lower surface 361 of the elevator 308 forms the upper end wall of the chamber 315. The upper surface 360 of the elevator forms a continuous and uninterrupted fluid boundary that bounds a lower end of the reservoir 314. The drive component 306, including the drive screw 350, does not protrude through the elevator 308, nor through the upper surface 360. Thought of another way, the drive component 306, including the drive screw 350, is completely isolated from the reservoir 314 and never comes into contact with the fluid within the reservoir 314, even when the elevator 308 is in a fully retracted state (as shown in FIG. 6).

The elevator 308 comprises a base portion 362 and a plug portion 363 extending axially from the base portion 362 along the longitudinal axis B-B toward the dispensing orifice 316. The plug portion 363 comprises an internal cavity having a closed top end and an open bottom end. When the dispenser 300 is assembled, and the elevator 308 is in a fully retracted position (as shown in FIG. 6), a distal portion of the drive screw 350 nests within the internal cavity of the plug portion 363 of the elevator 308. However, as can be seen, the drive screw 350 still does not penetrate through the elevator 308 or its outer surface 360. Furthermore, the outer surface 360 of the elevator 308 can comprise more than one surface. When the elevator is axially advanced through the reservoir 314 and reaches a fully extended position (not illustrated), the reservoir 314 will be substantially emptied of the fluid.

The elevator 308 is non-rotatable with respect to the housing 301 but can be axially translated relative thereto. Relative rotation between the elevator 308 and the housing 301 can be prevented by designing the elevator 308 and the cavity 313 to have corresponding non-circular transverse cross-sectional shapes. However, in the exemplified embodiment where circular transverse cross-sections are utilized, relative rotation between the elevator 308 and the housing 301 is prevented by non-rotatably coupling the anti-rotation sleeve 304 to the elevator 308. As mentioned above, the anti-rotation sleeve 304 is non-rotatable with respect to the housing 301 as a result of an interlocking groove/ridge cooperation that is achieved between the inner surface of the housing 301 and the anti-rotation sleeve 304.

The elevator 308 is coupled to the drive screw 350 so that relative rotation between the drive screw 350 and the elevator 308 axially advances the elevator 308 toward the dispensing orifice 316, thereby expelling a volume of the fluid from the reservoir 314. In the exemplified embodiment, the elevator 308 is coupled to the drive screw 350 via the extension member 307, through the use of male and female threads, which will be described in greater detail below. The elevator 308 further comprises an annular groove formed into its lower surface 361 of the base portion 362 for coupling to the extension member 307.

In alternative embodiments, the elevator 308 may be coupled directly to the drive screw 350, through the use of male and female threads, thereby eliminating the extension member 307. However, the extension member 307 may be preferred in some embodiments so that the elevator 308 does not have to be penetrated by the drive screw 350 while still affording an adequate distance of axial displacement of the elevator 308.

In the exemplified embodiment, the extension member 307 is a tubular sleeve structure that extends from a proximal end 368 to a distal end 369. However, in certain other embodiments, the extension member may be in the form of a frame, struts, or one or more elongate rods extending from a threaded collar to the elevator 308. The extension member 307 has an inner surface that forms an axial passageway that extends through the entirety of the extension member 307. The inner surface comprises a threaded portion 370A and a non-threaded portion 370B. The threaded portion 370A is located at the proximal end 368 of the extension member 307 and comprises a threaded surface that operably mates with the threaded surface of the drive screw 350 when the dispenser 300 is assembled. Further, when the dispenser is assembled, and the elevator 308 is in the fully retracted position (as shown in FIG. 6), the drive screw 350 extends through the entirety of the axial passageway of the extension member 380.

The elevator 308 is coupled to the extension member 307 through insertion of the distal end 369 of the extension member 307 into the elevator 308. Of course, the coupling between the elevator 308 and the extension member 307 can be effectuated in a variety of different ways, none of which are limiting of the present invention. Furthermore, in certain embodiments, the elevator 308 and the extension member 307 may be integrally formed as a unitary structure, rather than as separate components.

Referring now to FIGS. 6 and 8 concurrently, the interaction between the resilient arm 347 and the plurality of protuberances 346 during operation of the dispenser 300 will be described. Rotating the actuator 303 in a first rotational direction $\omega_1$ causes the drive component 306 to also rotate in the first rotational direction $\omega_1$, thereby causing: (1) the elevator 308 to axially advance along the drive screw 350 in the first axial direction $AD_1$ to dispense the fluid from the dispensing orifice 316; and (2) the resilient arm 347 to move over the plurality of protuberances 346. As the resilient arm 347 is rotated within the second section 330B of the axial passageway in the first rotational direction $\omega_1$, the resilient arm 347 comes into contact with each of the plurality of protuberances 346 consecutively. As the resilient arm 347 is forced to move over each of the plurality of protuberances 346, the resilient arm 347 deforms (which in the exemplified embodiment is a bending). As the rotation continues and the resilient arm 347 passes over each of plurality of protuberances 346, the resilient arm 347 snaps back and resumes its original state (shown in FIG. 8), thereby generating an audible signal, which is in the form of a "click" in certain embodiments. This "click" informs the user that the fluid has been dispensed and allows the user to dispense a precise and reproducible amount of the fluid based on the number of "clicks."

Figure 14:
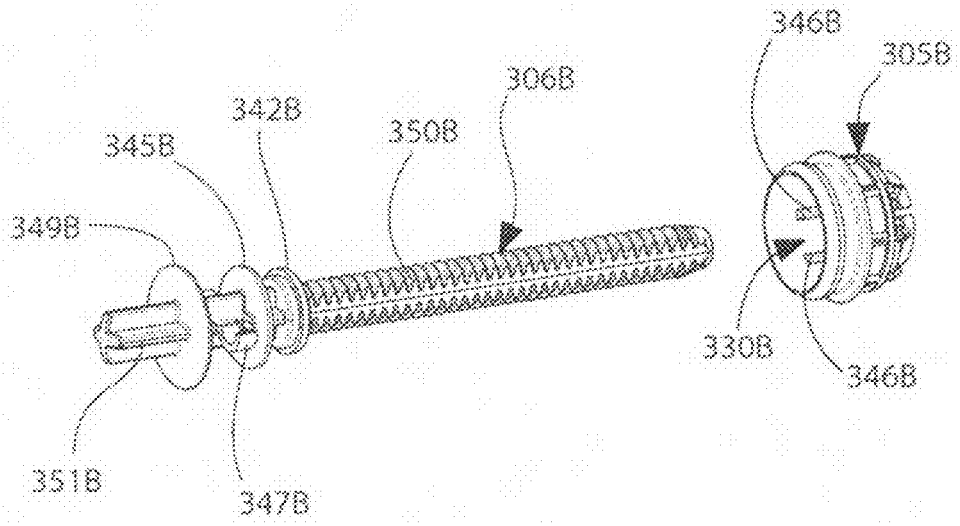
FIG. 14 is perspective view of a drive component and a collar that can be used in the oral care dispenser of FIG. 4 according to an alternative embodiment of the present invention.
Figure 15:
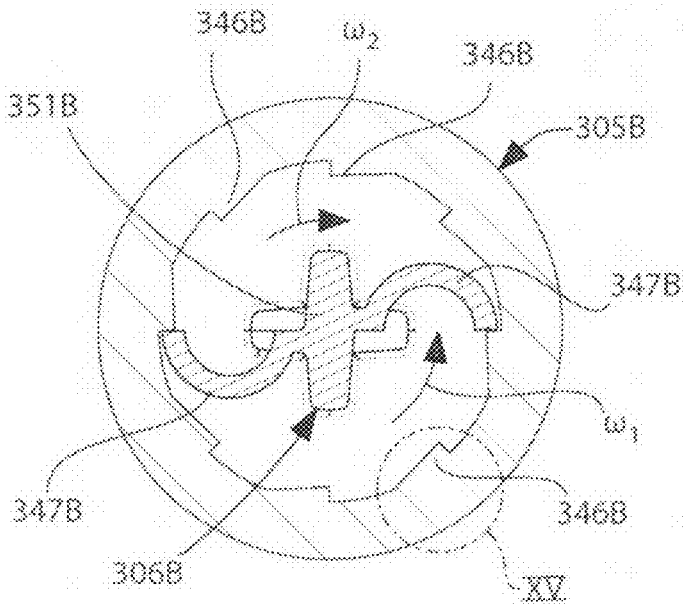
FIG. 15 is a transverse cross-sectional view of the drive component and the collar of FIG. 14 in operable coupling.
Figure 15A:
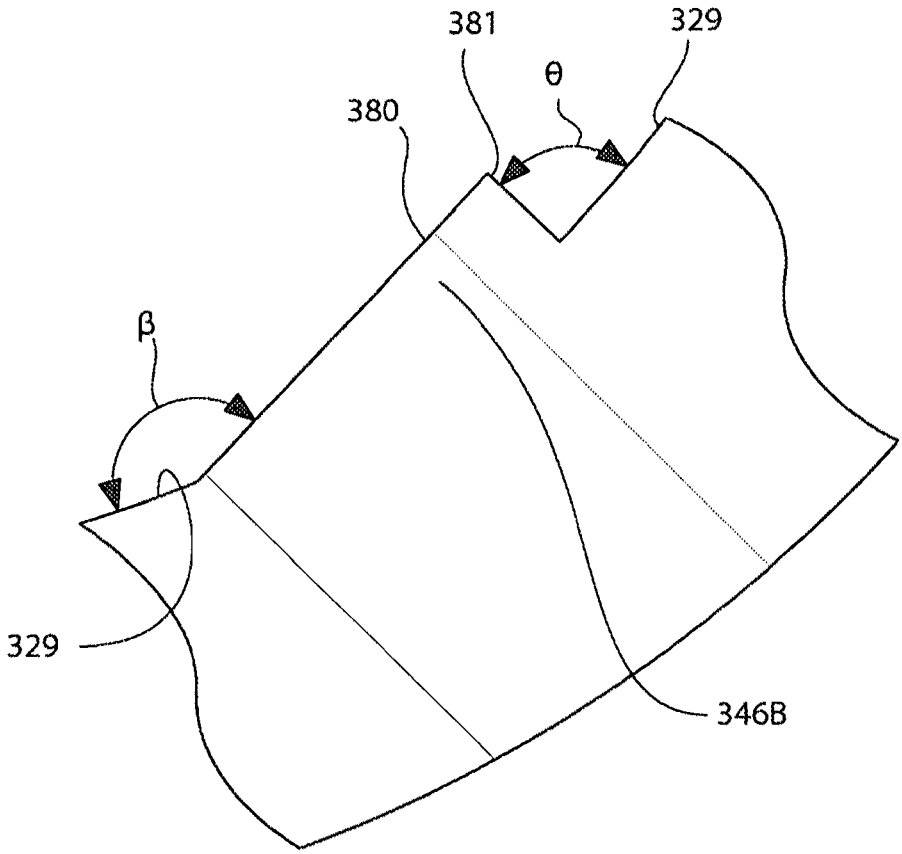
FIG. 15A is a close-up view of area XV of FIG. 15.

Referring now to FIGS. 14, 15 and 15A concurrently, alternate embodiments of the drive component 306B and the collar 305B that can be incorporated into the dispenser 300 are illustrated. The drive component 306B and the collar 305B are substantially identical to the drive component 306 and the collar 305 discussed above with exception of the resilient arms 347B and the plurality of protuberances 346B. Thus, the description below will be limited as such with the understanding the description above with respect to FIGS. 1-13 is applicable in all other regards.

The drive component 306B comprises a pair of resilient arms 347B extending radially outward from the post 351B. Unlike the resilient arm 347 of the drive component 306, each of the resilient arms 347B of the drive component 306B are curved in their extension in a second rotational direction $\omega_2$ rather than being straight/linear. As exemplified, each of the resilient arms 347B are substantially C-shaped in transverse cross-section (shown in FIG. 15). Of course, in other embodiments, each of the resilient arms 347B can take on other curved shapes.

In the exemplified embodiment, the resilient arms 347B comprise a first resilient arm 347B and second resilient arm 347B that are circumferentially spaced apart from one another on the post 351B by approximately 180°. Of course, other circumferential spacing can be utilized as desired. Moreover, in alternate embodiments of the invention, more or less than two of the resilient arms 347B can be used.

Similar to the resilient arm 347 and the protuberances 346, when the drive component 306B is operably coupled to the collar 305 and the drive component 306B is rotated in the first rotational direction $\omega_1$ relative to the collar 305B, the resilient arms 347B slide over each of the plurality of protuberances 346B. As the resilient arms 347B slide over each of the plurality of protuberances 346B, the resilient arms 347B deform radially inwardly to allow the resilient arms 347B to pass over the plurality of protuberances 346B. When the terminal ends of the resilient arms 347B pass the plurality of protuberances 346B, the resilient arms 347B resume their original state, thereby generating an audible signal as discussed above.

However, unlike the interaction between the resilient arm 347 and the protuberances 346, the interaction between the plurality of protuberances 346B and the resilient arms 347B prevents rotation of the drive component 306B (and, in turn the actuator 303) in the second rotational direction $\omega_2$. Thus, when the drive component 306B is used in conjunction with the collar 305B in the dispenser 300, the elevator 308 can be axially advanced only in the first axial direction $AD_1$.

In order to achieve the aforementioned functionality, each of the plurality of protuberances 346B comprises a lead surface 380 and a trail surface 381. The lead surface 380 is oriented so that the resilient arms 2478 can be easily slid over the protuberances 346B during rotation in the first rotational direction $\omega_1$. To the contrary, the trail surface 381 is oriented so that the resilient arms 247B cannot slide back over the trail surface 381 when resilient arms 347B have passed the trail surface 381 and are then rotated in the second rotational direction $\omega_2$. Stated simply, the trail surface 381 acts as stopping surfaces that engage the terminal ends of the resilient arms 347B.

In one embodiment, this is accomplished by orienting the lead surfaces 380 so that they extend from the inner surface 329 of the collar 305B at a sufficiently large first angle $\beta$ while the trail surfaces 381 are oriented to extend from the inner surface 329 of the collar 305B at a sufficiently small second angle $\Theta$. The first angle $\beta$ is greater than the second angle $\Theta$. In one embodiment, the first angle $\beta$ is in a range of 135° to 160° while the second angle $\Theta$ is in a range of 30° to 100°.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care dispenser comprising:

a housing having a longitudinal axis and an internal reservoir containing a fluid;

a collar non-rotatably coupled to the housing, the collar comprising an axial passageway, a neck portion having an inner surface forming a first section of the axial passageway, a body portion forming a second section of the axial passageway, and a plurality of protuberances extending radially inward from an inner surface of the body portion, the neck portion formed by a plurality of segments that protrude axially from the body portion, wherein adjacent ones of the plurality of segments are separated by a gap;

a drive component rotatably coupled to the collar, the drive component comprising a first annular flange located adjacent a distal edge of the neck portion, a drive screw extending from the first annular flange in a first axial direction, a post extending from the first annular flange in a second axial direction and through the axial passageway, and at least one resilient arm extending radially outward from the post in the second section of the axial passageway; and wherein rotation of an actuator in a first rotational direction causes: (1) an elevator to axially advance along the drive screw in the first axial direction to dispense the fluid from a dispensing orifice; and (2) the at least one resilient arm to move over the plurality of protuberances, the at least one resilient arm deforming when moving over each of the plurality of protuberances and resuming an original state upon passing each of the plurality of protuberances to generate an audible signal.

2. The oral care dispenser according to claim 1 wherein the collar comprises an annular shoulder portion between the neck portion and the body portion.

3. The oral care dispenser according to claim 2 wherein the drive component comprises a second annular flange located adjacent the annular shoulder portion of the collar in the second section of the axial passageway, wherein the second annular flange cannot fit through an opening defined by the annular shoulder portion, the neck portion located between the first and second annular flanges.

4. The oral care dispenser according to claim 3 wherein the opening defined by the annular shoulder portion has a first diameter, the first annular flange has a second diameter, and the second annular flange has a third diameter, and wherein the first diameter is greater than the second diameter and less than the third diameter.

5. The oral care dispenser according to any one of claims 3 to 4 wherein the drive component comprises a third annular flange located adjacent a proximal edge of the collar, wherein the third annular flange cannot fit through an opening defined by the proximal edge of the collar, the at least one resilient arm located between the second and third annular flanges.

6. The oral care dispenser according to any one of claims 1 to 5 wherein the first section of the axial passageway has a first transverse cross-sectional area and the second section of the axial passageway has a second transverse cross-sectional area that is greater than the first transverse cross-sectional area.

7. The oral care dispenser according to any one of claims 1 to 6 wherein the inner surface of the neck portion is obliquely oriented to the longitudinal axis so that the first transverse cross-sectional area tapers toward the distal edge.

8. The oral care dispenser according to any one of claims 1 to 7 wherein the inner surface of the body portion is substantially parallel to the longitudinal axis.

9. The oral care dispenser according to any of claims 1 to 8 wherein the distal edge of the neck portion defines an opening, and wherein the first annular flange can pass through the opening defined by the distal edge of the neck portion when translated in the first axial direction from a position within the first section of the axial passageway, and wherein contact between the distal edge of the neck portion and the first annular flange prohibits the first annular flange from passing through the opening defined by the distal edge of the neck portion when translated in the second axial direction from a position beyond the distal edge of the neck portion.

10. The oral care dispenser according to any of claims 1 to 9 wherein the at least one resilient arm comprises a straight resilient arm.

11. The oral care dispenser according to any of claims 1 to 9 wherein the plurality of protuberances are arranged in a circumferentially spaced-apart manner about the longitudinal axis, and wherein the plurality of protuberances and the at least one resilient arm are configured so that contact between the at least one resilient arm and the plurality of protuberances prevents rotation of the actuator in a second rotational direction that is opposite the first rotational direction.

12. The oral care dispenser according to claim 11 wherein the at least one resilient arm comprises a first resilient arm that is curved in the second rotational direction and a second resilient arm that is curved in the second rotational direction, the second resilient arm circumferentially spaced apart from the first resilient arm by approximately 180°.

13. The oral care dispenser according to claim 12 wherein the first and second resilient arms are substantially C-shaped in transverse cross-section.

14. The oral care dispenser according to any one of claims 1 to 13 wherein the drive component is a single unitary component.

15. The oral care dispenser according to any one of claims 1 to 14 wherein the collar comprises a flange portion in abutment with and protruding from a proximal end of the housing, the body portion located within the housing, and the post protruding from the flange portion of the collar in the second axial direction.

16. The oral care dispenser according to any one of claims 1 to 15 wherein the body portion is a non-segmented annular structure.

17. An oral care system comprising:

a toothbrush;

the oral care dispenser according to any one of claims 1 to 16, wherein the oral care dispenser is configured to be detachably coupled to the toothbrush.

18. An oral care dispenser comprising:

a housing having a longitudinal axis and an internal reservoir containing a fluid;

a collar non-rotatably coupled to the housing, the collar comprising an inner surface forming an axial passageway, a neck portion forming a first section of the axial passageway and a body portion forming a second section of the axial passageway wherein the inner surface of the collar comprising a plurality of features arranged in a circumferentially spaced-apart manner about the longitudinal axis, the neck portion formed by a plurality of segments that protrude axially from the body portion, wherein adjacent ones of the plurality of segments are separated by a gap, and wherein the plurality of features extend radially inward from the body portion;

a drive component rotatably coupled to the collar, the drive component comprising a drive screw, a post, and one or more resilient arms extending radially outward from the post, the one or more resilient arms being curved in a second rotational direction about the longitudinal axis;

wherein rotation of an actuator in a first rotational direction causes: (1) an elevator to axially advance along the drive screw in a first axial direction to dispense the fluid from a dispensing orifice; and (2) the one or more resilient arms to move over the plurality of features; and wherein interaction between the plurality of features and the one or more resilient arms prevents rotation of the actuator in the second rotational direction.

19. The oral care dispenser according to claim 18 wherein the plurality of features comprise a plurality of protuberances extending radially inward from the inner surface of the collar into the axial passageway, and wherein rotation of the actuator in the first rotational direction causes the one or more resilient arms to deform when moving over each of the plurality of protuberances and resuming an original state upon passing each of the plurality of protuberances to generate an audible signal.

20. The oral care dispenser according to claim 19 wherein the each of the plurality of protuberances comprises: (1) a lead surface over which the one or more resilient arms can slide during rotation of the actuator in the first rotational direction; and (2) a trail surface that engages a terminal edge of the one or more resilient arms when the actuator is rotated in the second rotational direction, thereby preventing further rotation of the actuator in the second rotational direction.

21. The oral care dispenser according to claim 20 wherein the lead surface extends from the inner surface of the collar at a first angle and the trail surface extends form the inner surface of the collar at a second angle, wherein the first angle is greater than the second angle.

22. The oral care dispenser according to any one of claims 18 to 21 wherein the drive component is a single unitary component.

23. The oral care dispenser according to any one of claims 18 to 22 wherein the one or more resilient arms are substantially C-shaped in transverse cross-section.

24. The oral care dispenser according to any one of claims 18 to 23 comprising a pair of the resilient arms circumferentially spaced from one another by about 180°.

25. The oral care dispenser according to claim 18 wherein the drive component comprises a first annular flange located adjacent a distal edge of the neck portion, wherein the distal edge of the neck portion defines an opening, and wherein the first annular flange can pass through the opening defined by the distal edge of the neck portion when translated in the first axial direction from a position within the first section of the axial passageway, and wherein contact between the distal edge of the neck portion and the first annular flange prohibits the first annular flange from passing through the opening defined by the distal edge of the neck portion when translated in the second axial direction from a position beyond the distal edge of the neck portion.

26. The oral care dispenser according to any one of claims 18 to 25 wherein the body portion is a non-segmented annular structure.

27. An oral care system comprising:

a toothbrush;

the oral care dispenser according to any one of claims 18 to 26, wherein the oral care dispenser is configured to be detachably coupled to the toothbrush.

28. An oral care dispenser comprising:

a housing having a longitudinal axis and an internal reservoir containing a fluid;

a collar non-rotatably coupled to the housing, the collar comprising an axial passageway, a segmented annular neck portion having an inner surface forming a first section of the axial passageway, a non-segmented annular body portion forming a second section of the axial passageway, and a plurality of protuberances extending radially inward from an inner surface of a non-segmented annular body portion;

a drive component rotatably coupled to the collar, the drive component comprising a drive screw extending from the first annular flange in a first axial direction, a post extending from the first annular flange in a second axial direction and through the axial passageway, and at least one resilient arm extending radially outward from the post in the second section of the axial passageway; and wherein rotation of an actuator in a first rotational direction causes: (1) an elevator to axially advance along the drive screw in the first axial direction to dispense the fluid from a dispensing orifice; and (2) the at least one resilient arm to move over the plurality of protuberances, the at least one resilient arm deforming when moving over each of the plurality of protuberances and resuming an original state upon passing each of the plurality of protuberances to generate an audible signal.

* * * * *

UNITED STATES PATENT AND TRADEMARK OFFICE

CERTIFICATE OF CORRECTION

PATENT NO. : 8,511,323 B2
APPLICATION NO. : 13/318291
DATED : August 20, 2013
INVENTOR(S) : Eduardo J. Jimenez et al.

It is certified that error appears in the above-identified patent and that said Letters Patent is hereby corrected as shown below:

In the claims:

Col. 20, lines 50-51, delete "any one of claims 3 to 4" and replace with -- claim 3 --

Col. 20, lines 56-57, delete "any one of claims 1 to 5" and replace with -- claim 1 --

Col. 20, lines 61-62, delete "any one of claims 1 to 6" and replace with -- claim 1 --

Col. 20, lines 65-66, delete "any one of claims 1 to 7" and replace with -- claim 1 --

Col. 21, line 1, delete "any of claims 1 to 8" and replace with -- claim 1 --

Col. 21, lines 12-13, delete "any of claims 1 to 9" and replace with -- claim 1 --

Col. 21, lines 16-17, delete "any of claims 1 to 9" and replace with -- claim 1 --

Col. 21, lines 33-34, delete "any one of claims 1 to 13" and replace with -- claim 1 --

Col. 21, lines 36-37, delete "any one of claims 1 to 14" and replace with -- claim 1 --

Col. 21, lines 42-43, delete "any one of claims 1 to 15" and replace with -- claim 1 --

Col. 21, lines 47-48, delete "any one of claims 1 to 16" and replace with -- claim 1 --

Col. 22, lines 33-34, delete "any one of claims 18 to 21" and replace with -- claim 18 --

Col. 22, lines 36-37, delete "any one of claims 18 to 22" and replace with -- claim 18 --

Col. 22, lines 39-40, delete "any one of claims 18 to 23" and replace with -- claim 18 --

Col. 22, lines 55-56, delete "any one of claims 18 to 25" and replace with -- claim 18 --

Col. 22, lines 60-61, delete "any of claims 18 to 26" and replace with -- claim 18 --

Signed and Sealed this
Eighteenth Day of March, 2014

Michelle K. Lee

Michelle K. Lee
*Deputy Director of the United States Patent and Trademark Office*